US007189148B2

(12) United States Patent
Toyoshima et al.

(10) Patent No.: US 7,189,148 B2
(45) Date of Patent: Mar. 13, 2007

(54) POLISHING APPARATUS

(75) Inventors: Yoshiaki Toyoshima, Tokyo (JP); Hideo Toriumi, Tokyo (JP); Shin-ichiro Taguchi, Tokyo (JP)

(73) Assignee: Hoya Corporation, Tokyo (JP)

( * ) Notice: Subject to any disclaimer, the term of this patent is extended or adjusted under 35 U.S.C. 154(b) by 0 days.

(21) Appl. No.: 11/284,652

(22) Filed: Nov. 22, 2005

(65) Prior Publication Data

US 2006/0073770 A1 Apr. 6, 2006

(51) Int. Cl.
*B24B 1/00* (2006.01)

(52) U.S. Cl. ..... 451/42; 451/384

(58) Field of Classification Search ..... 451/42–44, 451/240, 255, 256, 277, 323, 488, 384, 390, 451/504, 921

See application file for complete search history.

(56) References Cited

U.S. PATENT DOCUMENTS 3,865,178 A * 2/1975 Legendre ..... 164/334
5,421,770 A 6/1995 Bobst
5,462,475 A * 10/1995 Kennedy ..... 451/384
5,916,017 A * 6/1999 Sedlock ..... 451/460
6,110,016 A * 8/2000 Coleman et al. ..... 451/42

FOREIGN PATENT DOCUMENTS

| | | |
|---|---|---|
| JP | 6-24853 | 4/1994 |
| JP | 06-091507 | 4/1994 |
| JP | 06-143118 | 5/1994 |
| JP | 07-116950 A | 5/1995 |
| JP | 10-337644 | 12/1998 |
| JP | 11-198014 | 7/1999 |
| JP | 2000-117604 A | 4/2000 |

* cited by examiner

*Primary Examiner*—Dung Van Nguyen
(74) *Attorney, Agent, or Firm*—J. D. Harriman, II; DLA Piper US LLP

(57) ABSTRACT

A polishing apparatus includes a polishing jig. The polishing jig includes an elastic balloon member, a fixture, and a fluid supply portion. The fixture airtightly closes the rear opening portion of the balloon member. The fluid supply portion supplies a fluid into a space formed by the fixture and balloon member. The balloon member has a cup shape constructed by a dome portion and a cylinder portion extending backward from the outer periphery of the dome portion. The fixture fixes the opening portion of the cylinder portion of the balloon member.

4 Claims, 27 Drawing Sheets

| LENS | | BLOCKING RING | | LENS HOLDER UNIT | GAP BETWEEN LENS CENTER AND LENS HOLDER UNIT |
|---|---|---|---|---|---|
| DIAMETER | BC | INNER DIAMETER | HEIGHT | HEIGHT | |
| 80 | 1.5 | 78 | 10 | 22.5 | 2.34 |
| 80 | 1.0 | 78 | 10 | 22.5 | 2.88 |
| 80 | 0.9 | 78 | 10 | 23.5 | 2.42 |
| 80 | 0.8 | 78 | 10 | 23.5 | 2.70 |
| 80 | 0.7 | 78 | 10 | 23.5 | 2.70 |
| 80 | 0.6 | 78 | 10 | 23.5 | 2.70 |

FIG.28A

| LENS | | BLOCKING RING | | LENS HOLDER UNIT | GAP BETWEEN LENS CENTER AND LENS HOLDER UNIT |
|---|---|---|---|---|---|
| DIAMETER | BC | INNER DIAMETER | HEIGHT | HEIGHT | |
| 75 | 2.0 | 73 | 7 | 19.5 | 1.90 |
| 75 | 1.75 | 73 | 7 | 19.5 | 2.37 |
| 75 | 0.5 | 73 | 7 | 20.5 | 2.80 |
| 75 | 0.4 | 73 | 7 | 20.5 | 2.80 |
| 75 | 0.3 | 73 | 7 | 20.5 | 2.80 |

FIG.28B

| LENS | | BLOCKING RING | | LENS HOLDER UNIT | GAP BETWEEN LENS CENTER AND LENS HOLDER UNIT |
|---|---|---|---|---|---|
| DIAMETER | BC | INNER DIAMETER | HEIGHT | HEIGHT | |
| 70 | 4.5 | 68 | 10 | 19.5 | 2.36 |
| 70 | 3.75 | 68 | 10 | 20.5 | 2.19 |
| 70 | 3.0 | 68 | 7 | 18.5 | 2.01 |
| 70 | 2.5 | 68 | 7 | 18.5 | 2.62 |
| 70 | 0.2 | 68 | 7 | 20.5 | 2.89 |
| 70 | 0.1 | 68 | 7 | 20.5 | 2.89 |

FIG.28C

| LENS | | BLOCKING RING | | LENS HOLDER UNIT | GAP BETWEEN LENS CENTER AND LENS HOLDER UNIT |
|---|---|---|---|---|---|
| DIAMETER | BC | INNER DIAMETER | HEIGHT | HEIGHT | |
| 65 | 7.5 | 63 | 10 | 17.5 | 2.22 |
| 65 | 6.75 | 63 | 10 | 18.5 | 1.95 |
| 65 | 6.0 | 63 | 10 | 18.5 | 2.66 |
| 65 | 5.25 | 63 | 10 | 19.5 | 2.38 |
| 65 | 0.0 | 63 | 7 | 21.5 | 1.98 |

FIG.28D

COMPARISON BETWEEN SPECIFIC GRAVITY AND PH OF ABRASIVE

| ABRASIVE | SPECIFIC GRAVITY | AVERAGE PARTICLE SIZE (μm) | PH |
|---|---|---|---|
| A ( ALUMINIUM OXIDE) | 1.251 | 1.5 | 3,4 |
| B (ALUMINIUM OXIDE) | 1.147 | 0.8 | 3.5 |

POLISHING APPARATUS

BACKGROUND OF THE INVENTION

The present invention relates to a polishing apparatus and, more particularly, to a polishing apparatus which arranges a polishing pad on the outer surface of an elastic dome formed on a base, thereby polishing lenses with various shapes.

Conventionally, to polish, using a polishing apparatus, the concave surface of a lens cut into a spherical or toric surface shape by an NC-controlled curve generator, a polishing pad is bonded to a metal polishing jig having a convex surface almost conforming to the shape of the concave surface to be polished. The polishing jig and lens are relatively slid while pressing the polishing pad against the concave surface to be polished.

In this polishing method, however, various polishing jigs must be prepared in accordance with the shapes of the concave surfaces of lenses to be polished. For, e.g., a toric lens for correcting astigmatism, there are 3,000 to 4,000 kinds of toric surfaces (part of a surface obtained by rotating an arc about an axis that is present in the same plane as that of the arc and does not pass through the center of the curvature of the arc), so a corresponding number of polishing jigs must be prepared. This increases the manufacturing cost of polishing jigs. In addition, a large storage space is necessary, and management thereof is cumbersome.

Not only a spherical surface or a toric surface but also a concave surface having a complex shape such as an aspherical surface (part of a surface of revolution whose curvature continuously changes from the apex to the periphery) shape, an atoric surface (a surface having principal meridians which have different curvatures and are perpendicular to each other, and the section of at least one principal meridian is a non-circular surface) shape, or a free-form surface shape of, e.g., a progressive-power lens may be formed. Such a concave surface cannot be polished by the conventional polishing method using a polishing jig.

As a method of solving these problems, for example, a polishing apparatus and polishing jig described in Japanese Patent Laid-Open No. 2000-117604 are known. This polishing apparatus comprises a holding tool which holds an object to be polished, a polishing jig having a flexible sheet that is expanded to a dome shape by a fluid pressure, and a polishing pad bonded to the surface of the flexible sheet. The surface to be polished in the object to be polished is polished by an abrasive supplied between the polishing pad and the surface to be polished along a trackless polishing locus in which the polishing locus shifts little by little for each revolution in accordance with the left-and-right/fore-and-aft movement of the holding tool and the swiveling movement of the polishing jig.

In polishing, the curvature of the dome is changed by changing the internal pressure of the flexible sheet. When the concave surface is a toric surface, and curvatures in directions perpendicular to each other are largely different, a spherical dome may not be able to cope with such a concave surface. In this case, presser jigs are pressed against the flexible sheet near the two end portions in one of the directions perpendicular to each other in the flexible sheet, thereby suppressing expansion of the sheet by the fluid pressure. Since the dome can have different curvatures in directions perpendicular to each other, a surface almost similar to the toric surface of the object to be polished can be obtained.

When the curvature of the dome is changed by the fluid pressure and presser jigs, one jig can cope with concave surface shapes in a wide range. For this reason, different polishing jigs need not be prepared in accordance with the shape of the concave surface. Hence, the number of polishing jigs can be greatly decreased.

In the polishing jig described in Japanese Patent Laid-Open No. 2000-117604, however, the peripheral portion of the flexible sheet is sandwiched and fixed by the disk-shaped fixing jig main body and a press jig which has a flat circular ring shape having the same diameter as that of the fixing jig main body. A sealed space is formed between the fixing jig main body and the flexible sheet, and the flexible sheet is expanded to a dome shape by the fluid pressure. In addition, the pair of presser jigs for suppressing the expansion of the sheet are attached onto the press jig so as to freely move in the radial direction of the dome. When the concave surface of a lens is to be polished by relatively sliding the polishing jig and lens which are kept in contact with each other, the lens must be prevented from touching the press jig and presser jigs located aside near the polishing surface of the polishing jig and, more particularly, the presser jigs.

When the sliding distance for polishing is shortened to keep the lens from the press jig or presser jigs, a large lens cannot be polished. To ensure a sufficient sliding distance, the polishing surface area is made much larger than the lens surface. In this case, the polishing jig becomes bulky. Additionally, when the dome curvature for the large polishing surface is increased, the polishing jig becomes considerably high. Also, to polish lenses with various diameters and concave surface shapes by one polishing jig using presser jigs, the size of the polishing jig must be set on the basis of the largest diameter lens to be polished. This also increases the polishing jig size. If the polishing jig is bulky, the weight and moment of inertia become large. This may impede the swiveling movement of the polishing jig.

Furthermore, in the above-described polishing jig, the polishing pad must be bonded to the dome surface by an adhesive because of the structure of the jig itself. Attaching/detaching the polishing pad is time-consuming.

To polish the concave surface of a lens, the curvature of the dome portion must almost equal the curvature of the lens. To do this, the polishing jig described in Japanese Patent Laid-Open No. 2000-117604 sets the curvature of the dome portion by the internal pressure of the flexible sheet. However, if the deformation amount of the dome portion is large with respect to the pressure variation amount, the pressure is hard to adjust in accordance with the curvature. In addition, when the flexible sheet degrades due to a change over time, the correlation between the pressure and the curvature changes. Hence, even when the pressure is kept unchanged, no desired curvature can be obtained.

The lens holding tool used together with the above-described polishing jig is generally formed from a lens holder unit and a low-melting alloy (to be also referred to as an alloy layer hereinafter).

As a typical conventional lens holding tool, a tool described in, e.g., U.S. Pat. No. 5,421,770 is known. FIG. 34 shows this lens holding portion. Referring to FIG. 34, reference symbol A denotes a lens holder unit; B, a lens; and C, an alloy layer. The lens holder unit A has a recess portion D in a surface a opposing the lens B. The recess portion D has, at its outer periphery, a step E that rises at an acute angle. A plurality of hollows F are vertically formed in the recess portion D. The step E prevents removal of the lens holder unit A from the alloy layer C. The hollows F prevents rotation of the lens holder unit A with respect to the alloy layer C. For these reasons, the lens holder unit A and alloy layer C are firmly connected.

When the lens B is held by the lens holder unit A and alloy layer C, the lens B deforms due to the influence of heat of the alloy layer C or shrinkage of the alloy layer C in hardening, as is known (Japanese Patent Laid-Open No. 7-116950).

Conventionally, however, plastic lenses for glasses are formed using a diethylene glycol bisallylcarbonate-based resin (n=1.50) that is a most general-purpose plastic lens material. In addition, a semifinished lens (a lens in which only the first refractive surface is optically finished) is designed to be thick. For these reasons, when the lens is fixed to the lens holder unit through the hardened low-melting alloy, the influence of heat or shrinkage of the alloy layer is small.

However, since lens materials have high refractive indices, and semifinished lenses become thinner recently, the influence of heat and shrinkage of the alloy layer increases. It is therefore urgently necessary to improve the lens holding tool. More specifically, an urethane- or epithio-based resin having a refractive index of 1.55 to 1.75 is used as a lens material in place of the diethylene glycol bisallylcarbonate-based resin having a refractive index of 1.5. In addition, to meet the requirement for reducing the material cost and saving the resources, the semifinished lens is thinned to reduce the cut amount on the concave surface side. Then, the influence of heat and shrinkage of the alloy layer becomes large. Especially, a semifinished lens for a minus-power lens is greatly influenced by heat and shrinkage of the alloy layer because the lens is thin at its center. Moreover, the alloy layer of the conventional lens holding tool has a large amount because of the above-described structure that increases the connection strength between the alloy layer and the lens holder unit. Hence, the influence of heat and shrinkage of the alloy layer is large.

In Japanese Patent Laid-Open No. 7-116950 described above, a bottom plate is inserted into the space between the lens holder unit and the lens to reduce the amount of alloy, thereby preventing deformation due to shrinkage at the time of hardening. However, even when the amount of alloy is reduced, the influence of heat and shrinkage may still remain because the central thickness of the alloy layer changes depending on the type of lens.

Conventionally, only the central portion of a lens is held by the alloy layer. Hence, the strength of lens at the central portion where the alloy layer is present is different from that at the outside portion. If the concave surface is cut or polished in this holding state, polishing marks may be formed on the concave surface at a portion corresponding to the boundary between the portion with the alloy layer and the portion without the alloy layer on the convex surface side.

To cut a concave surface in the preprocess of the lens polishing process, an NC-controlled curve generator is generally used. However, when the concave surface of a lens is cut using the curve generator, a process step (undulation) is formed on the cut surface due to backlash.

More specifically, the tool (turning tool) for cutting a lens moves vertically and horizontally and makes a complex movement with inflection points. When the turning tool is moved using a ball screw, and the direction of rotation of the ball screw changes, a process step M having a size of several μm is formed near an inflection point due to, e.g., backlash generated by the play of the ball screw, as shown in FIGS. 35A and 35B. Even when the turning tool is moved using a linear motor, a similar process step is formed due to, e.g., a delay in control when the moving direction reverses. The process step M must be removed in the next polishing step to obtain a concave surface having a desired curvature. FIG. 35A shows a state during polishing using a polishing pad P. FIG. 35B shows a state after polishing. Reference symbol S denotes a concave surface of a lens; and T, a balloon member (to be described later) of the polishing jig.

However, when a surface is polished using the polishing jig which expands a sheet by a fluid pressure to form a dome-shaped surface, the polishing surface is elastic. For this reason, even when the concave surface S is polished using the relatively soft polishing pad P (made of, e.g., a non-woven fabric) that is conventionally used in a metal polishing jig, as shown in FIG. 35A, the polishing pad and dome-shaped surface follow the shape of the process step M, as shown in FIG. 35B. For this reason, the process step M cannot be completely removed. The process step M with a size of about 1 to 2 μm still remains. In this case, when the polishing time is prolonged, and a polishing margin corresponding to the process step is added to the normal polishing margin, the process step M can be removed. However, since the surface must be polished more than necessity, the polishing time becomes long. In addition, the outer appearance quality and optical accuracy of the lens degrade.

SUMMARY OF THE INVENTION

It is the principal object of the present invention to provide a polishing apparatus having a polishing jig which is smaller than before and can cope with various lens shapes.

It is another object of the present invention to provide a polishing apparatus having a polishing jig which can easily replace the polishing pad.

It is still another object of the present invention to provide a curvature setting apparatus for a polishing apparatus dome portion, a curvature setting method for a polishing apparatus dome portion, and a polishing apparatus, which can measure the curvature of a dome portion suitable for the curvature of a lens more accurately than before.

It is still another object of the present invention to provide a curvature setting apparatus for a polishing apparatus dome portion, a curvature setting method for a polishing apparatus dome portion, and a polishing apparatus, which can accurately measure the curvature of a dome portion independently of aging of the apparatus.

It is still another object of the present invention to provide a polishing apparatus, a lens holding tool, and a method of forming a lens holding tool for a polishing apparatus, which increase the accuracy of finishing by reducing deformation of even a thin lens and accordingly increase the accuracy of finishing of the lens.

It is still another object of the present invention to provide an optical lens polishing method which obtains an accurately polished lens by eliminating a process step formed on the lens at the time of cutting.

In order to achieve the above objects, according to the present invention, there is provided a polishing apparatus comprising a polishing jig, the polishing jig including an elastic balloon member, a fixture which airtightly closes a rear opening portion of the balloon member, and a fluid supply portion which supplies a fluid into a space formed by the fixture and the balloon member, wherein the balloon member has a cup shape constructed by a dome portion and a cylinder portion extending backward from an outer periphery of the dome portion, and the fixture has a structure which fixes an opening portion of the cylinder portion of the balloon member.

BRIEF DESCRIPTION OF THE DRAWINGS

FIGS. 28A to 28D are tables showing the dimensional relationships between the type of lens, the type of blocking ring, the type of lens holder unit, and the gap between the lens center and the lens holder unit;

DESCRIPTION OF THE PREFERRED EMBODIMENTS

The present invention will be described below on the basis of embodiments illustrated.

First Embodiment

Figure 1:
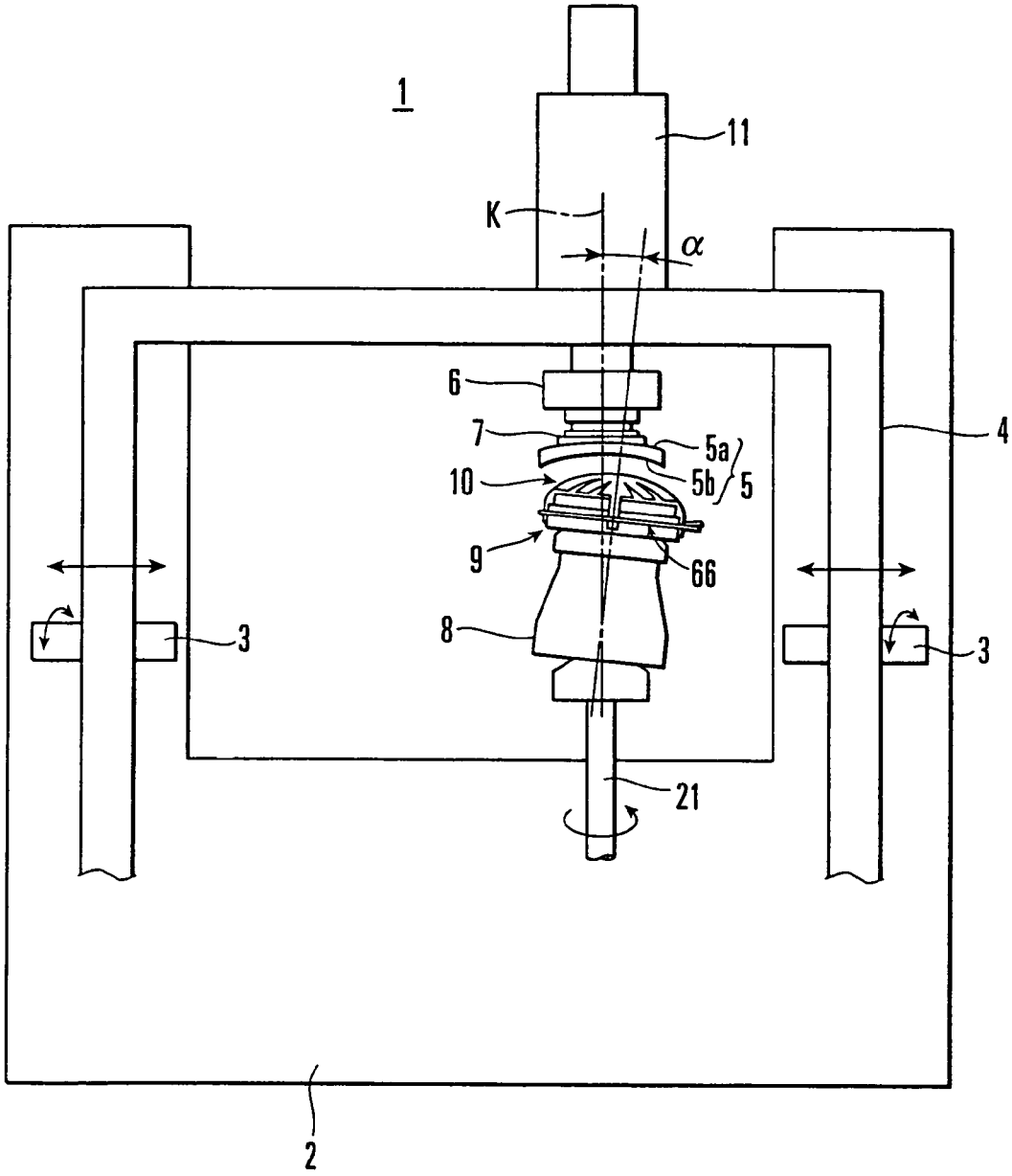
FIG. 1 is a view showing the schematic arrangement of a polishing apparatus according to the present invention.

FIG. 1 shows the basic arrangement of a polishing apparatus according to the present invention. In the embodiment to be described below, the present invention is applied to a polishing apparatus which polishes, as an object to be polished, a concave surface formed from a toric surface of a plastic lens for correcting astigmatism. The lens to be polished is represented by an urethane- or epithio-based plastic lens.

Referring to FIG. 1, a spectacle lens polishing apparatus 1 comprises an apparatus main body 2 installed on the floor surface, an inverted-U-shaped arm 4 which can freely pivot in a direction perpendicular to the drawing surface about horizontal shafts 3 that are movable to the left and right on the drawing surface, a driving unit (not shown) which reciprocally moves the arm 4 to the left and right and also pivots the arm 4 in the direction perpendicular to the drawing surface, a lens attachment portion 6 which is arranged on the arm 4 to hold a convex surface 5*a* of a lens 5 through a lens holding tool 7, a swinging unit 8 which makes swiveling movement (without rotation about its axis) about a vertical axis line K by a driving unit (not shown), and the like. The polishing apparatus 1 also comprises a polishing jig 9 detachably arranged on the swinging unit 8, a polishing pad 10 detachably attached to the polishing jig 9, a lifting unit 11 which vertically moves the lens attachment portion 6, and the like. The polishing apparatus 1 is the same as a conventional apparatus that is widely used except that the polishing jig 9 has a new structure. For example, a general-purpose polishing apparatus (TORO-X2SL) commercially available from LOH is used to polish a concave surface 5*b* formed from the spherical surface or toric surface of the lens 5.

The concave surface 5*b* of the lens 5 is cut into a predetermined toric surface shape in advance by a curve generator (to be described later with reference to FIG. 29) which performs three-dimensional NC control. The lens 5 is attached to the lens holding tool 7.

Figure 3:
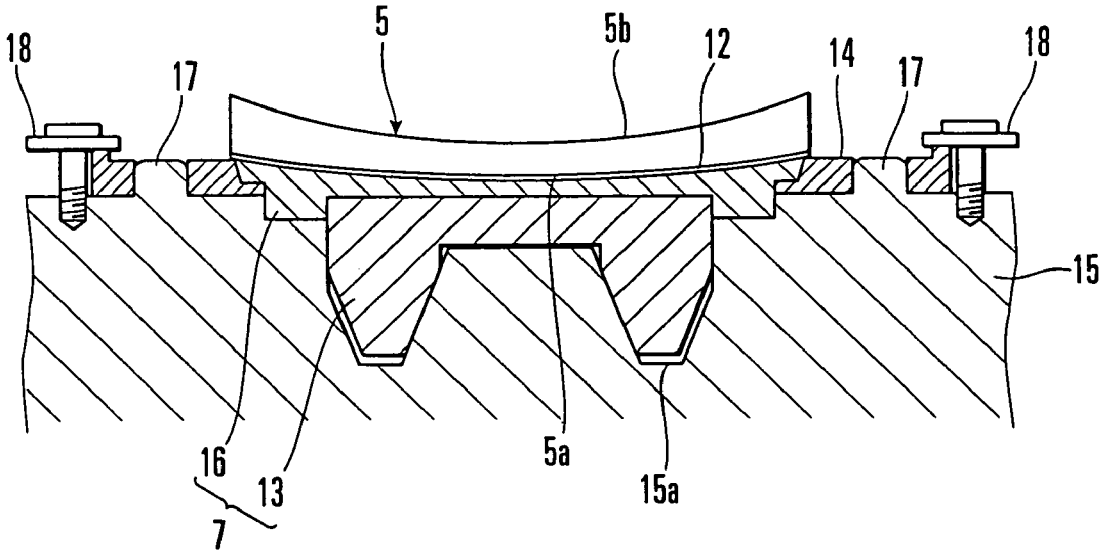
FIG. 3 is a sectional view showing a state wherein the lens holding tool is attached to the lens by a layout blocker.

To attach the lens holding tool 7 to the lens 5, a protective film 12 which is made of polyethylene or the like and prevents flaws is bonded to the convex surface 5*a* of the lens 5 in advance, as shown in FIG. 3.

The lens holding tool 7 is constructed by a lens holder unit 13 separated from the lens 5 and its convex surface 5*a*, and an adhesive 16 inserted between the lens holder unit 13 and the convex surface 5*a* of the lens 5. As the adhesive 16, an alloy layer formed from a low-melting alloy (e.g., an alloy of Bi, Pb, Sn, Cd, and In with a melting point of about 47° C.) is normally used.

To fix the lens 5 and lens holder unit 13 via the alloy layer 16, the lens holder unit 13 formed from tool steels or the like is fitted in a depressed portion 15*a* formed in a mount 15 of the layout blocker shown in FIG. 3. A blocking ring 14 is placed around the lens holder unit 13, positioned by positioning pins 17, and fixed by fixtures 18.

Figure 2:
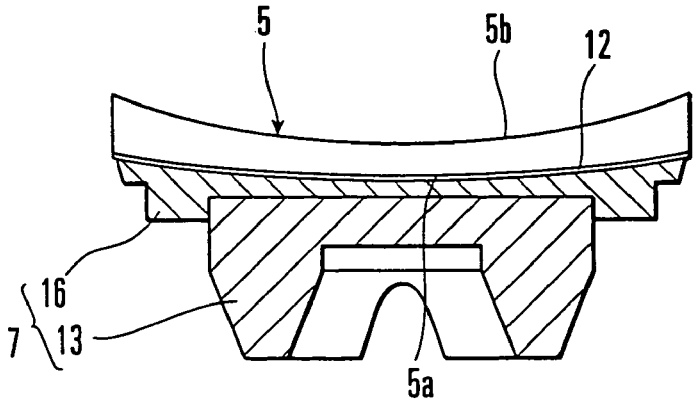
FIG. 2 is a sectional view showing a state wherein a lens holding tool is attached to a lens.

The lens 5 having the protective film 12 bonded thereto and the convex surface 5*a* facing down is placed on the blocking ring 14. Then, the space formed by the lens 5, lens holder unit 13, blocking ring 14, and the upper surface of the mount 15 is filled with the molten alloy layer 16. When the alloy layer 16 is cooled and hardened, the lens 5 is bonded to the lens holder unit 13. After that, the lens holder unit 13 attached to the lens 5 is detached from the depressed portion 15*a* of the mount 15. The lens holding tool 7 to which the lens 5 is attached, as shown in FIG. 2, is thus obtained.

The lens holding tool 7 having the lens 5 with the concave surface 5*b* facing down is attached to the lens attachment portion 6 of the arm 4 of the polishing apparatus 1 shown in FIG. 1. The sizes of the lens holder unit 13 and blocking ring 14 to be used change depending on the dioptric power and outer diameter of the lens 5 and the curvature of the convex surface 5*a*.

The swinging unit 8 of the polishing apparatus 1 shown in FIG. 1 is attached to a vertical rotating shaft 21 with an inclination to swivel at a swing angle $\alpha$ (e.g., 5°) The polishing jig 9 is attached to the upper surface of the swinging unit 8.

FIGS. 4 to 7 show the polishing jig 9 in detail. The polishing jig 9 is constructed by an elastic balloon member 25 having a cup shape and an open back, a fixture 26 which closes the rear opening portion of the balloon member 25 and holds airtightness in a resultant internal space, and a valve 27 which supplies compressed air into the balloon member 25.

Figure 4:
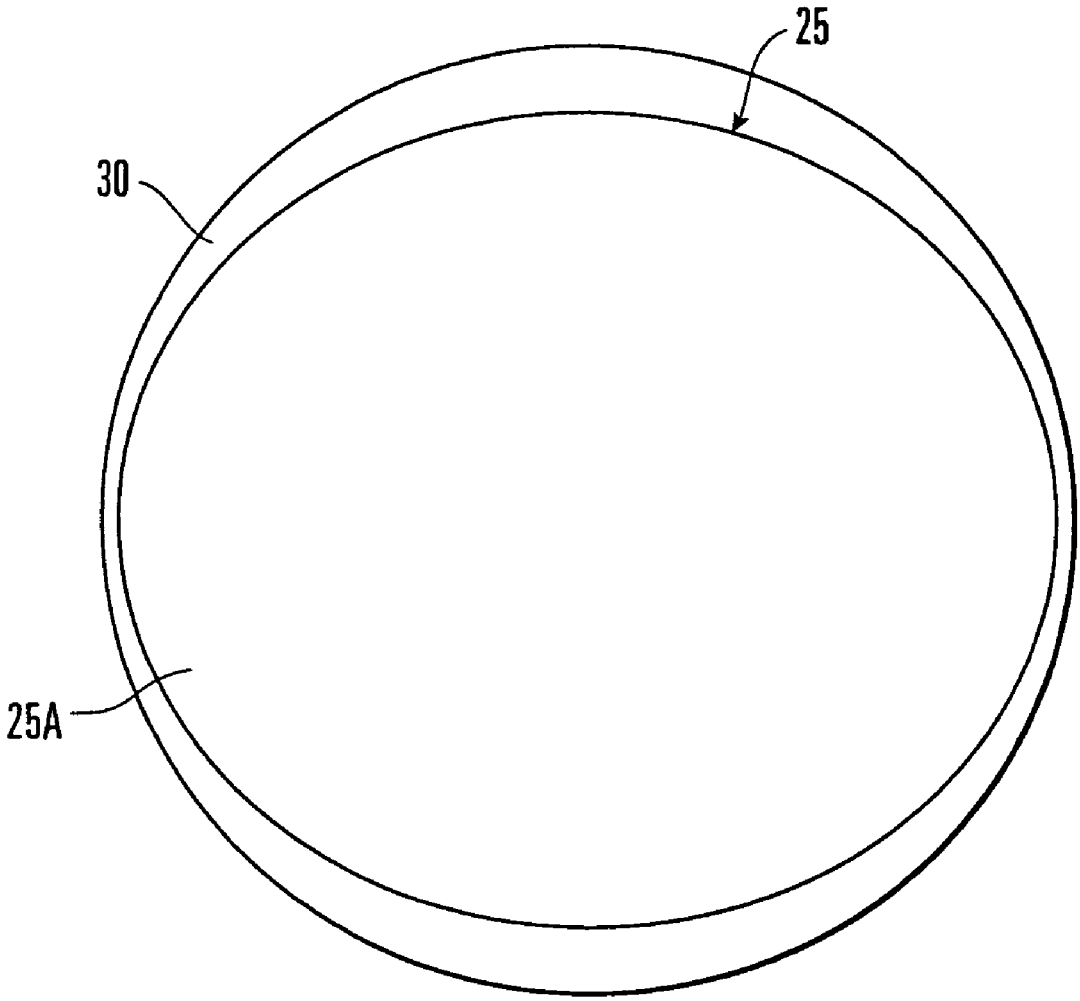
FIG. 4 is a plan view of a polishing jig.
Figure 7:
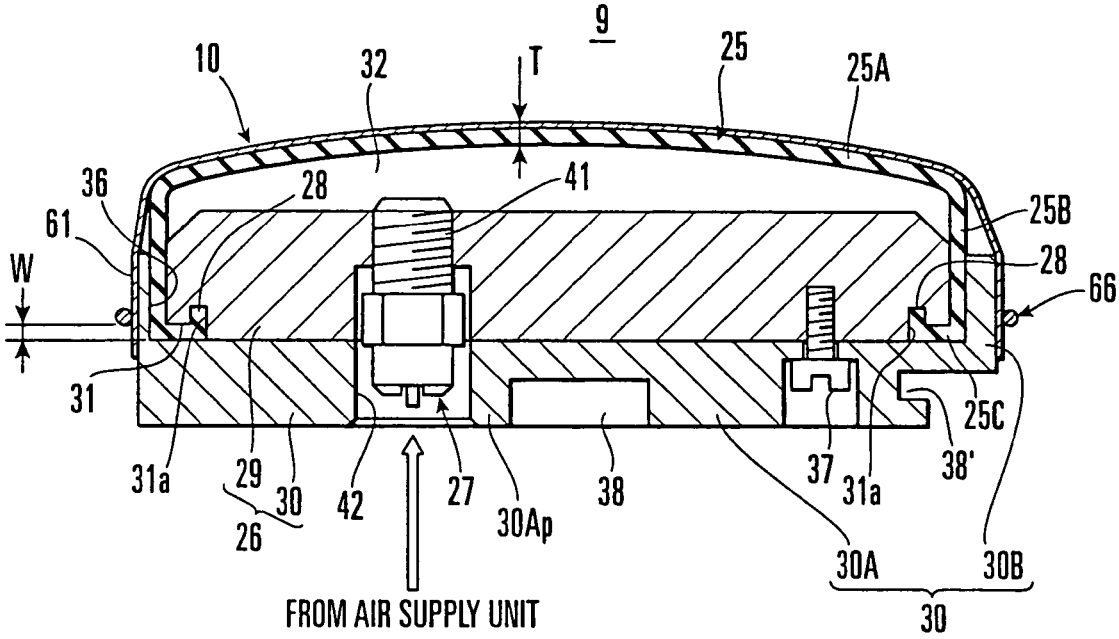
FIG. 7 is a sectional view taken along a line VII—VII in FIG. 5.

As shown in FIGS. 4 and 7 in detail, the balloon member 25 is formed from a dome portion 25A having an almost elliptical shape when viewed from the front side and a flat or moderate convex surface, a cylinder portion 25B having an almost elliptical shape and integrally extending downward from the outer periphery of the dome portion 25A, and an annular inner flange 25C integrally extending from the rear end of the cylinder portion 25B. Since the balloon member 25 has the dome portion 25A which is made of a flat or moderate convex surface having an almost elliptical shape and the almost elliptical cylinder portion 25B integrally extending downward from the outer periphery of the dome portion 25A, the balloon member 25 deforms while it holds its flexibility, and the cylinder portion 25B maintains the shape holding ability. For this reason, the balloon member 25 can make the dome portion 25A follow up to the non-polished surface while holding the shape to some extent.

An annular lock portion 28 projecting upward is integrated with the inner edge of the inner flange 25C, as shown in FIG. 7. This lock portion 28 engages with an inner fixture 29 (to be described later) to temporarily fix the balloon member 25 to the inner fixture 29, thereby facilitating assembly of the polishing jig 9. In addition, the lock portion 28 prevents undesirable detachment of the balloon member 25 from the fixture 26 and ensures the internal airtightness when an outer fixture 30 is attached.

The balloon member 25 is formed from an elastic material such as natural rubber, synthetic rubber, or a gum resin. For example, synthetic rubber (e.g., IIR) close to natural rubber or natural rubber having a hardness of 20° to 50° is used. The balloon member 25 has a uniform thickness T of about 0.5 to 2 mm (normally a uniform thickness of about 1 mm). A plurality of kinds of balloon members 25 having different sizes are preferably prepared in accordance with the size of the lens 5 to be polished or the shape of the surface to be polished.

In addition, when the balloon member 25 is formed from such a flexible elastic material, the balloon member 25 can change its shape in accordance with the shape of the polished surface.

As shown in FIG. 7 in detail, the fixture 26 is constructed by two members, i.e., the above-described inner fixture 29 and outer fixture 30. The inner fixture 29 and outer fixture 30 clamp the inner flange 25C and lock portion 28 of the balloon member 25 from the inside and outside, thereby sealing the rear opening portion of the balloon member 25.

The inner fixture 29 is made of an elliptical plate having almost the same size as that of the inner size of the cylinder portion 25B of the balloon member 25. The peripheral edge of the upper surface of the inner fixture 29 is chamfered. An annular groove 31 fitted on the inner flange 25C is formed at the peripheral portion of the lower surface. An annular groove 31a fitted on the lock portion 28 is formed on the inner peripheral side of the annular groove 31. A depth W of the annular groove 31 is set to be slightly smaller than the thickness (T) of the inner flange 25C. In addition, the height of the inner fixture 29 is set to be smaller than that of the cylinder portion 25B. With this structure, the inner fixture 29 and dome member 25 form a sealed space 32 inside the balloon member 25.

The inner fixture 29 is fitted in a depressed portion 36 of the outer fixture 30 together with the cylinder portion 25B of the balloon member 25 and fixed in the depressed portion 36 by a plurality of hexagon socket head cap screws 37 (FIGS. 6 and 7) inserted from the lower surface side of the outer fixture 30. Since the inner flange 25C of the balloon member 25 is pressed against the bottom surface of the depressed portion 36, the rear opening portion of the balloon member 25 is sealed by the inner fixture 29 and outer fixture 30.

Figure 5:
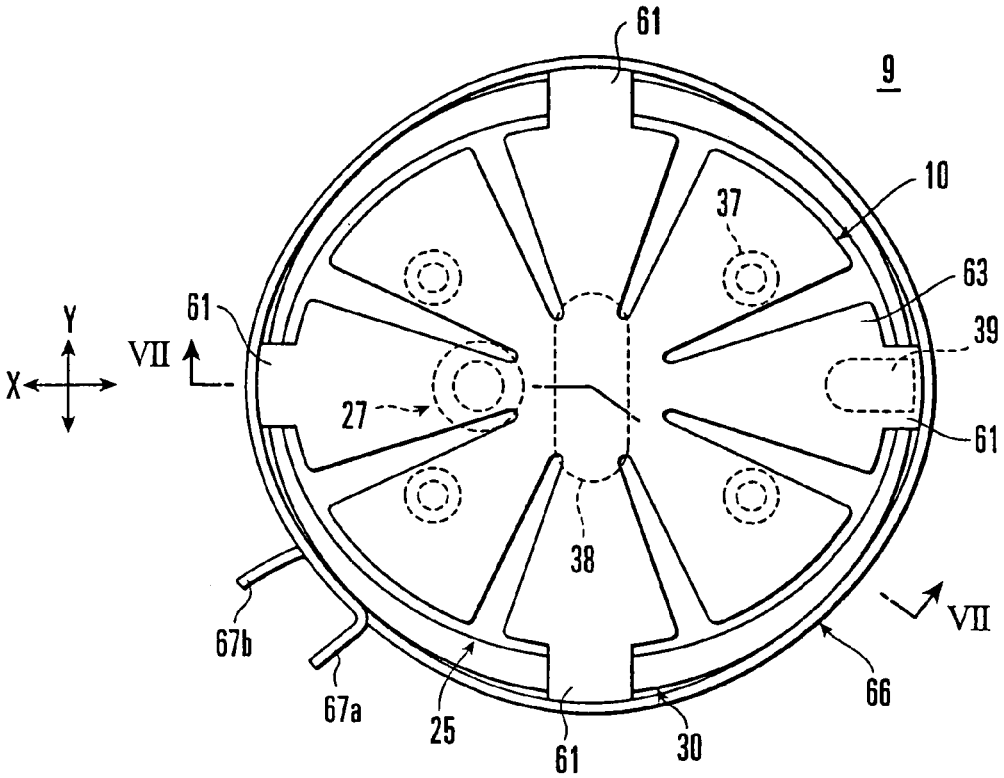
FIG. 5 is a plan view of the polishing jig to which a polishing pad is attached.
Figure 8:
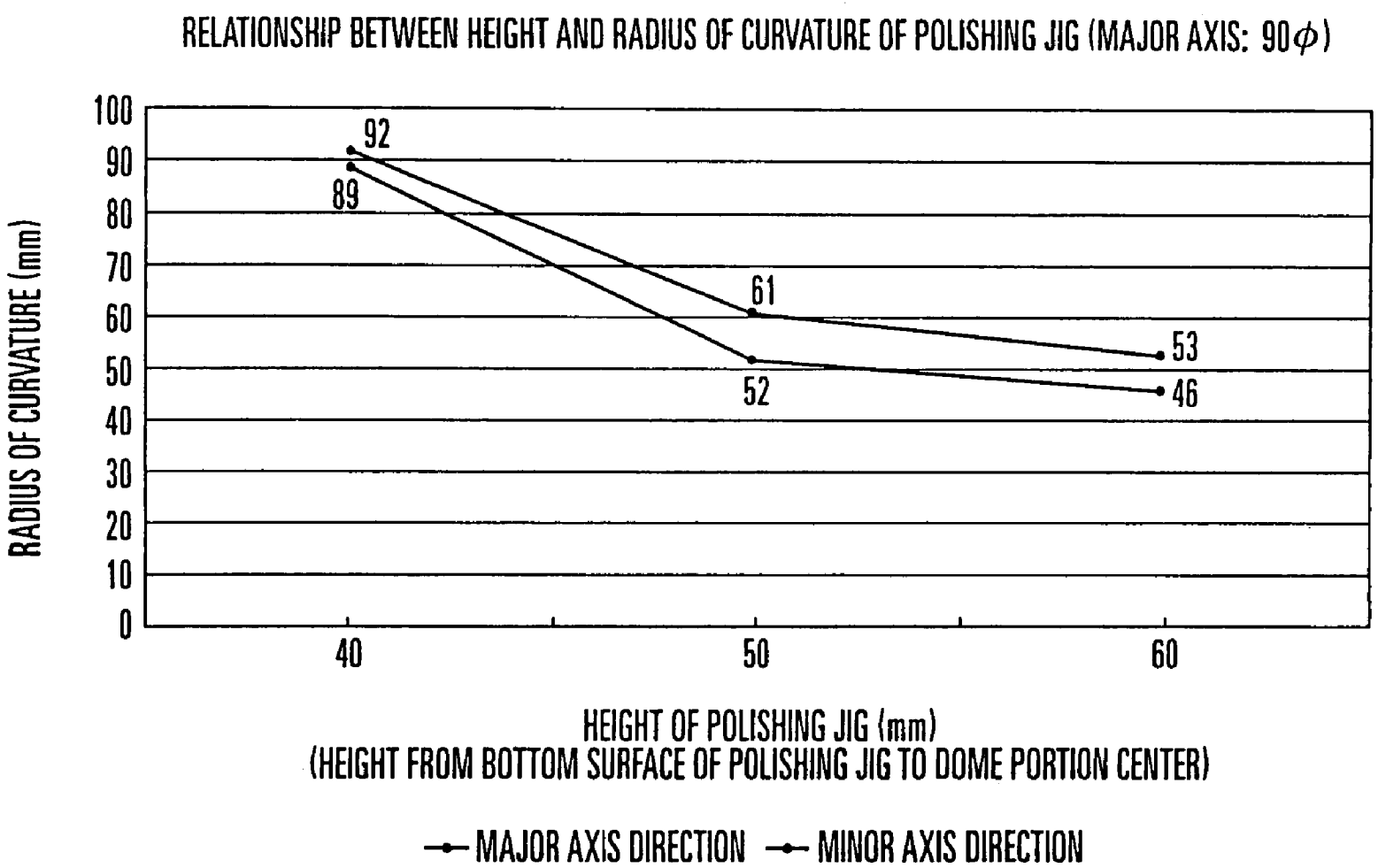
FIG. 8 is a graph showing the relationship between the height and the radius of curvature of the polishing jig.

When compressed air is supplied into the sealed space 32 through the valve 27 to expand the dome portion 25A, a shape close to a toric surface is formed in which the radius of curvature of a section containing the central axis of the dome portion 25A is minimum in the direction of minor axis of the ellipse (Y direction in FIG. 5) and maximum in the direction of major axis (X direction in FIG. 5). In this case, the radius of curvature of the dome portion 25A changes depending on the central height (apex height) of the dome portion 25A, as shown in FIG. 8. Hence, when the height of the dome center is measured and adjusted by an appropriate apparatus, a desired radius of curvature can be obtained for the dome portion 25A. To make the shape of the dome portion 25A close to the concave surface 5*b* of the lens 5, it is preferable to prepare a plurality of kinds of dome portions having different minor and major axis sizes or different ratios of axis sizes. When an appropriate one of the dome portions is selectively used, the shape of the dome portion can be made closer to the concave surface shape of the lens 5. The radius of curvature of the dome portion 25A is preferably set to be smaller than that of the concave surface 5*b* of the lens 5 because a gap is hardly formed between the central portion of the concave surface and the central portion of the dome portion when the lens concave surface is pressed against the dome portion 25A. FIG. 8 shows the relationship between the jig height (the height from the polishing jig bottom surface to the center of the dome portion) and the radius of curvature of the dome portion in a polishing jig having a balloon member in which the size of the major axis of the dome portion 25A is 90 [mm], and the ratio of the minor axis size to the major axis size is 0.9. Note that the height of the jig used here before air injection (the jig height when the pressure in the sealed space 32 equals the atmospheric pressure) is 30 mm.

In this embodiment, to polish lenses whose concave surfaces 5*b* are formed from toric surfaces each having a lens diameter of 65, 70, 75, or 80 [mm], a refractive index of 1.7, a base curve of 0.00 to 11.25 [D], and an astigmatic dioptric power range of 0.00 to 4.00 [D], eight polishing jigs 9 in which the ratio of the minor axis size to the major axis size of the balloon member 25 is 0.9, and the major axis sizes are 65, 70, 75, 80, 85, 90, 95, and 100 [mm], and one polishing jig 9 whose balloon member 25 has an almost circular shape and an outer diameter of 100 mm, i.e., a total of nine polishing jigs 9 are prepared and appropriately selectively used.

The polishing jig 9 is appropriately selected in accordance with the lens diameter and the curvature of the surface to be polished. For lenses having the same diameter, a polishing jig with a smaller major axis is preferably used for a larger curvature. For example, in polishing toric lenses with a diameter of 70 mm, when the lens had a base curve of 0.00 to 1.50 [D] and an astigmatic dioptric power of 0.00 to 2.00 [D], a polishing jig whose major axis size was 100 [mm] was used. If the lens had the same base curve and an astigmatic dioptric power of 2.25 to 4.00 [D] or more, a polishing jig whose major axis size was 90 [mm] was used. If the base curve was 1.75 to 6.00 [D], and the astigmatic dioptric power was 0.00 to 4.00 [D], a polishing jig whose major axis size was 90 [mm] was used (if the base curve was 2.75 to 6.00 [D], and the astigmatic dioptric power was 2.25 to 4.00 [D], the size of the major axis was 80 [mm]). If the base curve was 6.25 to 11.25 [D], and the astigmatic dioptric power was 0.00 to 4.00 [D], a polishing jig whose major axis size was 80 [mm] was used (except when the base curve was 10.00 to 11.25 [D], and the astigmatic dioptric power was 2.25 to 4.00 [D]). It was thus confirmed that lenses within the entire dioptric power range could be polished by appropriately setting the height, pressure, and rotational speed of the dome portion 25A, and the polishing time.

Referring to FIG. 7, the outer fixture 30 has a cup shape open upward and is constructed by a disk-shaped bottom plate 30A and a cylinder portion 30B integrally projecting from the periphery of the upper surface of the bottom plate 30A. The inner surface of the cylinder portion 30B forms the depressed portion 36 in which the inner fixture 29 is fitted together with the cylinder portion 25B of the balloon member 25.

The inner fixture 29 is fitted in the depressed portion 36 together with the cylinder portion 25B of the balloon member 25 and fixed in the depressed portion 36 by the plurality of screws 37 from the lower surface side of the outer fixture 30. Since the inner flange 25C of the balloon member 25 is pressed against the bottom surface of the depressed portion 36, the rear opening portion of the balloon member 25 is sealed by the inner fixture 29 and outer fixture 30.

When an engaging recess portion 38 and engaging grooves 38' formed in the bottom surface of the outer fixture 30 engage with engaging portions (not shown) formed on the upper surface of the swinging unit 8, the outer fixture 30 is positioned and fixed on the swinging unit 8.

The depressed portion 36 of the outer fixture 30 has almost the same size as the outer size of the cylinder portion 25B of the balloon member 25. The depressed portion 36 has a depth of about 10 mm, lower than the cylinder portion 25B and is therefore formed into an elliptical shape. Hence, when the balloon member 25 is attached to the fixture 26, the cylinder portion 25B projects upward from the outer fixture 30.

By forming the upper edge of the outer fixture 30 low, interference between the lens 5 and the outer fixture 30 can be prevented even when the polishing jig 9 swivels in polishing the lens 5. This is because the upper edge of the outer fixture is lower than the moving region of the lens. The outer fixture 30 has a circular outer shape. This is because a clamping member 66 having an almost circular ring shape can uniformly apply a force when the polishing pad 10 is clamped.

Figure 6:
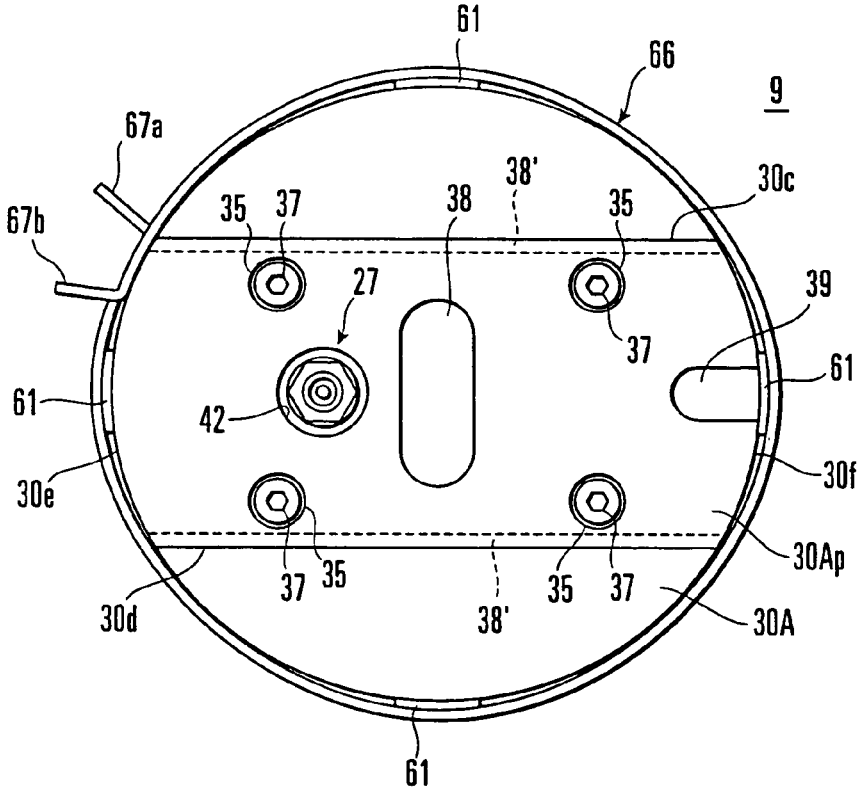
FIG. 6 is a bottom view of the polishing jig.

A projecting portion 30Ap projects from the center of the bottom surface of the main body 30A. The projecting portion 30Ap has two straight sides 30*c* and 30*d* parallel to each other and two arcs 30*e* and 30*f* which connect the ends of the straight sides 30*c* and 30*d*. The longitudinal direction of the projecting portion 30Ap matches the direction of major axis of the depressed portion 36 (X direction in FIG. 5). The engaging recess portion 38 long in a direction perpendicular to the major axis direction of the depressed portion 36 is formed at the center of the lower surface of the projecting portion 30Ap. A hole 42 for receiving the valve 27 is formed on one side of the engaging recess portion 38. In addition, a positioning recess portion 39 and four threaded holes 35 for receiving the hexagon socket head cap screws 37 which fix the inner fixture 29 in the depressed portion 36 are formed. Two threaded holes 35 are formed on each side of the engaging recess portion 38. The positioning recess portion 39 positions the polishing jig 9 installed in a curvature setting apparatus 70 (to be described later). As shown in FIGS. 6 and 7, the positioning recess portion 39 is open to the arc 30*f* on the opposite side of the valve 27 with respect to the engaging recess portion 38 along the major axis direction of the depressed portion 36. The engaging grooves 38' are formed along the straight sides 30*c* and 30*d* of the projecting portion 30Ap while extending their full length. When the polishing jig 9 is installed on the swinging unit 8, the engaging grooves 38' and engaging recess portion 38 engage with the engaging portions (not shown) formed on the upper surface of the swinging unit 8, thereby positioning and fixing the polishing jig 9.

Figure 9:
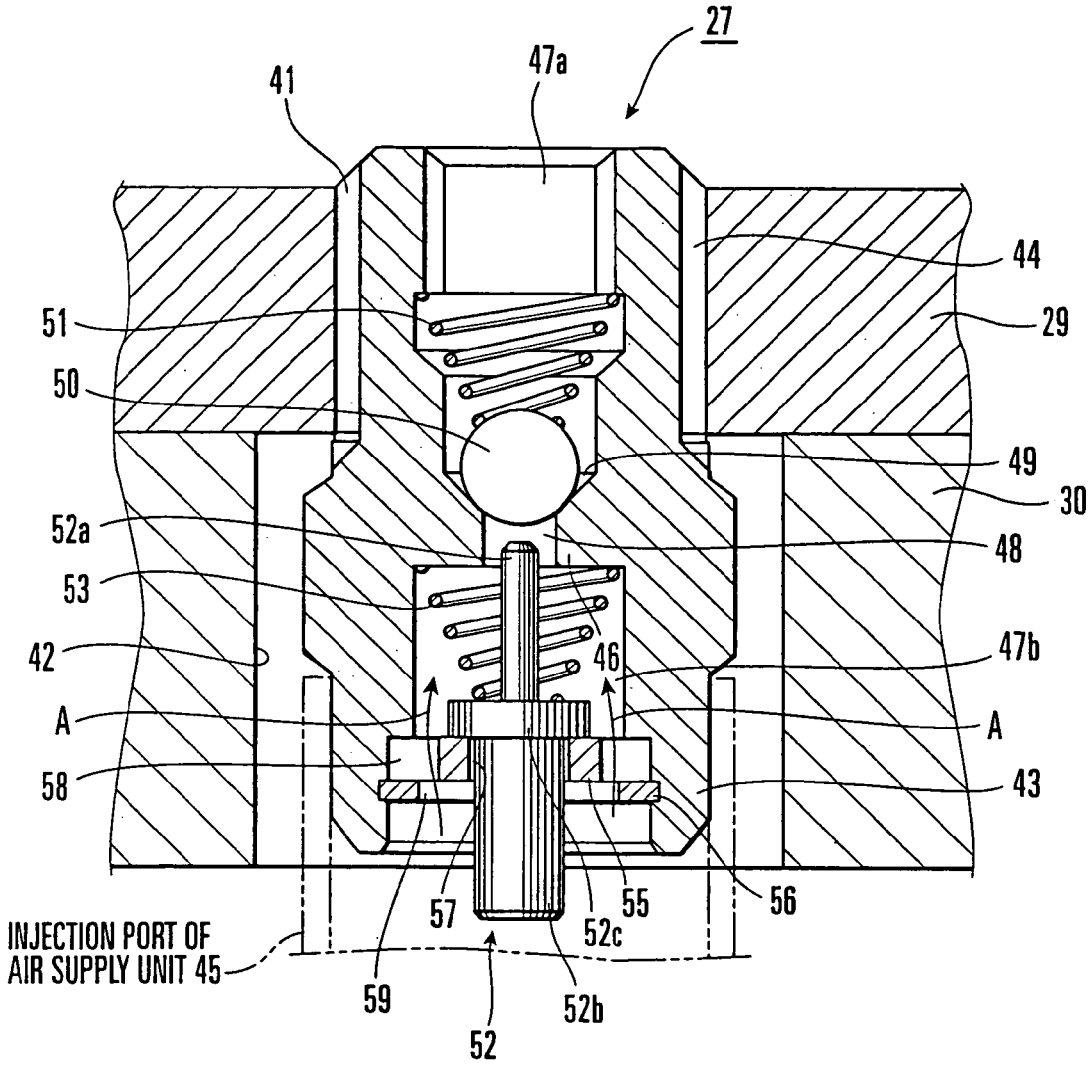
FIG. 9 is a sectional view of a valve which supplies air into a sealed space formed in a balloon member.
Figure 10:
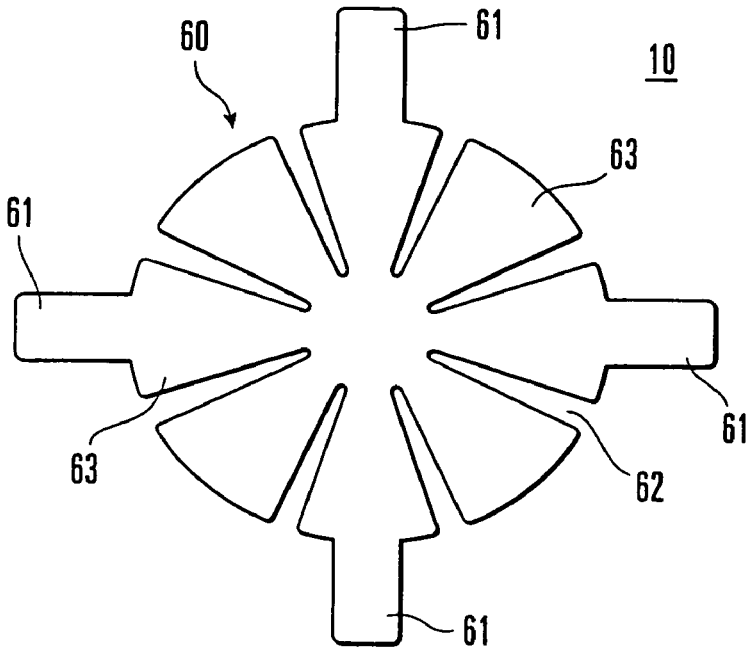
FIG. 10 is a plan view of the polishing pad.

FIG. 9 shows details of the valve 27 shown in FIG. 7. Referring to FIG. 9, the valve 27 has a cylindrical valve main body 43 screwed into a threaded hole 41 formed in the inner fixture 29 through the through hole 42 formed in the outer fixture 30. An external thread 44 threadably engages with the threaded hole 41 of the inner fixture 29 is formed on the outer periphery of the upper end portion of the valve main body 43. The lower end portion of the valve main body 43 is inserted and connected to an injection port 45 of an air supply unit (not shown). The interior of the valve main body 43 is partitioned at its center into two, upper and lower chambers 47*a* and 47*b* by a partition 46. A small hole 48 is formed at the center of the partition 46, through which the chambers 47*a* and 47*b* communicate with each other. A conical bearing portion 49 is formed on the upper opening portion of the small hole 48. The upper chamber 47*a* has a ball 50 which is fitted in the bearing portion 49 to close the small hole 48 and a conical coil spring 51 which presses the ball 50 against the bearing portion 49.

The lower chamber 47*b* shown in FIG. 9 has an exhaust pin 52, a conical coil spring 53 which biases the exhaust pin 52 downward, a receiving portion 55 which slidably holds the exhaust pin 52, and an E-ring 56 which prevents the receiving portion 55 from dropping. The exhaust pin 52 has a small-diameter portion 52*a*, a large-diameter portion 52*b*, and a flange 52*c* integrally formed between the small- and large-diameter portions 52*a* and 52*b*. The upper end portion of the small-diameter portion 52*a* is inserted into the small hole 48 and located immediately under the ball 50. The large-diameter portion 52*b* extends through a central hole 57 of the receiving portion 55 and the E-ring 56 and projects downward from the valve main body 43. The receiving portion 55 is locked by the E-ring 56. The receiving portion 55 has, at its outer periphery, a plurality of grooves 58 that form a fluid channel. The flange 52*c* of the exhaust pin 52 is pressed against the upper surface of the receiving portion 55 by the conical coil spring 53. The E-ring 56 is fixed near the lower opening portion inside the valve main body 43 and holds the receiving portion 55.

Compressed air is supplied into the sealed space 32 of the balloon member 25 by inserting and connecting the valve main body 43 to the injection port 45 of the air supply unit. More specifically, when the valve main body 43 is inserted into the injection port 45, compressed air from the air supply unit is guided to the small hole 48 through the fluid supply port 45, the central hole of the E-ring 56, the grooves 58 of the receiving portion 55, and the lower chamber 47*b* of the valve main body 43, as indicated by an arrow A in FIG. 9, to push up the ball 50 against the spring force of the conical coil spring 51. Accordingly, the small hole 48 is opened. The compressed air is supplied to the sealed space 32 of the balloon member 25 through the upper chamber 47*a* to expand the dome portion 25A.

As the compressed air is supplied, the pressure in the sealed space 32 increases. When the central height of the dome portion 25A reaches a desired height, supply of compressed air is stopped, and the valve 27 is removed from the injection port 45. When the valve 27 is removed from the injection port 45, the lower chamber 47*b* returns to the atmospheric pressure. Hence, the ball 50 is pressed against the bearing portion 49 by the spring force of the conical coil spring 51 to close the small hole 48.

To exhaust the compressed air from the sealed space 32 to return the dome portion 25A to the natural state as before, the exhaust pin 52 is manually pushed up against the conical coil spring 53 to push up the ball 50 and separate it from the bearing portion 49. Accordingly, the small hole 48 is opened, the sealed space 32 obtains the atmospheric pressure, and the dome portion 25A is returned to the original shape by the restoring force of its own.

As shown in FIGS. 5 and 6, the polishing pad 10 used to polish the concave surface 5*b* of the lens 5 is made of a sheet material such as polyurethane foam, felt, a fibrous fabric such as a non-woven fabric, or a synthetic resin. The thickness of the polishing pad 10 is about 1 mm. More specifically, the polishing pad 10 is constituted by a polishing portion 60 formed into an ellipse having almost the same size as that of the dome portion 25A of the balloon member 25 viewed from the front side, and a plurality of fixing pieces or lead piece 61 extending outward from the peripheral edge of the polishing portion 60. The polishing portion 60 has eight petal pieces 63 radially formed by a plurality of notches 62 formed from the periphery toward the center.

Each petal piece 63 is formed into a trapezoidal shape when viewed from the upper side so that the petal piece 63 is narrow on the central side and wide on the peripheral side. The fixing pieces 61 radially extend from the peripheral edges of a total of four petal pieces 63 located in the directions of major and minor axes of the eight petal pieces 63. The width of the fixing piece 61 is set to be smaller than the width of the peripheral edge of the petal piece 63. With this structure, the fixing piece 61 readily deflects when the balloon member 25 deforms during polishing or the fixing piece 61 is pulled from the clamping member 66 (to be described later).

If the fixing piece 61 is too wide, it hardly deflects because of poor flexibility. If the fixing piece 61 is too narrow, it readily ruptures during polishing because of low strength. Hence, the width of the fixing piece 61 is determined in consideration of the strength and flexibility. For example, when a 1 mm thick felt sheet is used, the width is preferably 5 to 15 mm. If the width is 5 mm or less, the durability decreases. If the width is 15 mm or more, the flexibility decreases, and the fixing piece 61 hardly follows deformation of the balloon member 25. At least two fixing pieces 61 are preferably arranged every predetermined interval. If the number of fixing pieces 61 is too large, the contact area between the fixing pieces 61 and the clamping member 66 (to be described later) increases. Since the pressure applied from the clamping member 66 to the fixing pieces 61 is dispersed and becomes low, the fixing pieces 61 are easily removed. To the contrary, if the number of fixing pieces 61 is too small, the polishing pad 10 cannot stably be fixed on the polishing jig 9. Hence, the number of fixing pieces 61 is preferably 3 to 5.

The polishing pad 10 is preferably hard. Hard felt or urethane foam is preferably used. When a hard polishing pad is used, the shape follow-up of the polishing pad to the process step when the polishing pad is pressed against the lens cut surface in polishing is suppressed to some extent. Hence, the process step can be removed.

The shape follow-up of the polishing pad to the process step when the polishing pad 10 is pressed against the lens cut surface is preferably set to be lower than that of the dome surface to the process step when the dome surface is pressed against the lens cut surface. With this setting, the dome surface is softer than the polishing pad 10. Since the dome surface can deform to make the polishing pad follow the shape of the cut surface when the polishing pad 10 is pressed against the lens cut surface in polishing, the surface can be satisfactorily polished while maintaining the surface shape of the cut surface accurately cut by the curve generator. In addition, since the polishing pad is harder, shape follow-up to the process step is suppressed to some degree, and the process step can be removed.

Furthermore, since the dome surface is softer than the polishing pad, the dome surface comes into tight contact with the lower surface of the polishing pad that is pressed against the lens cut surface. For this reason, a force can be uniformly applied to the lens cut surface, and the surface can be satisfactorily polished.

The hardness of the polishing pad 10 is higher than that of the central portion of the dome surface of the balloon member 25 and, preferably, 70 to 85 (JIS-A). In this range, the shape follow-up of the polishing pad to the process step is appropriately suppressed, and the process step can be removed. In addition, since the polishing pad appropriately follows the lens cut surface, any portion can be sufficiently polished.

To measure the hardness of the polishing pad 10, a durometer (GS-719N available from Teclock) of JIS K6253 type A was used. For measurement, polishing pads to be measured were stacked over 6 mm and placed on a horizontal table. The durometer was vertically pressed against the polishing pads at a constant speed to bring them into tight contact. The maximum value was read and measured. The hardness of the central portion of the dome surface of the balloon member 25 was also measure using the durometer. For measurement, the polishing jig to which air was supplied was placed on a horizontal table. The durometer was pressed against the central portion (apex portion) of the dome surface at a constant speed. The maximum value was read and measured. By such measurement, the hardness of the central portion of the dome surface of the balloon member 25 is preferably 5 to 45 (JIS-A). In this range, the polishing pad can be made to follow the shape of the lens cut surface while keeping the dome surface in tight contact with the lower surface of the polishing pad. Hence, the surface can be satisfactorily polished.

Figure 11:
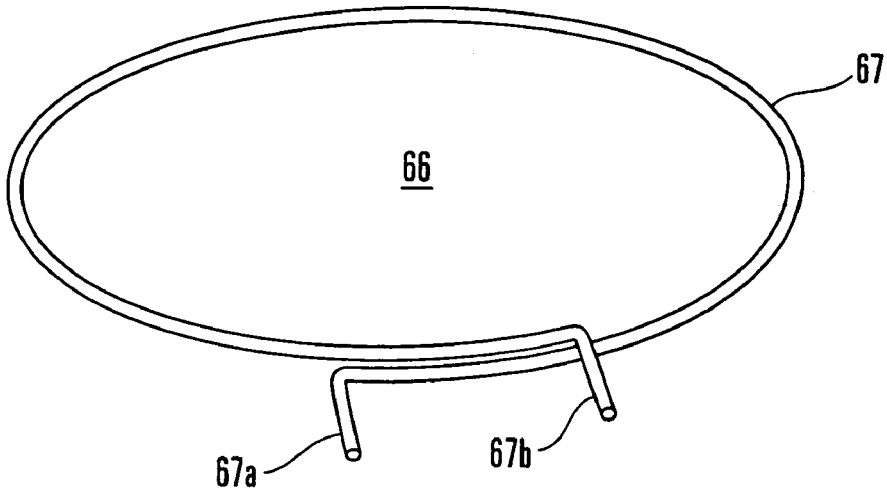
FIG. 11 is a perspective view of a clamping member for the polishing pad.

The polishing pad 10 is detachably attached to the polishing jig 9 by the clamping member 66. The clamping member 66 is formed by bending a wire spring or coil spring 67 with an appropriate thickness into a circular shape and making two end portions 67*a* cross each other, as shown in FIG. 11. In a natural state, the clamping member 66 has a diameter smaller than the outer diameter of the outer fixture 30, and the two end portions 67*a* are bent outward. The ring shape of the clamping member 66 is appropriately set in accordance with the outer shape of the outer fixture 30 such that a uniform force is applied to the fixing pieces 61 in clamping. It is preferable that the outer fixture 30 have a circular outer shape, and the clamping member 66 in clamping have a circular ring shape they need not be oriented.

To attach the polishing pad 10 to the polishing jig 9, first, compressed air is supplied to make the balloon member 25 to a predetermined dome shape. The polishing portion 60 is placed on the balloon member 25. Then, the two end portions 67*a* of the clamping member 66 are picked up with fingers. When the interval between the two end portions 67*a* is decreased, the diameter of the clamping member 66 increases. In this state, the clamping member 66 is pressed against the fixing pieces 61 of the polishing pad 10 from the upper side. The fixing pieces 61 are bent downward and brought into contact with the outer periphery of the outer fixture 30. When the fingers are released from the two end portions 67*a,* the clamping member 66 returns to the shape as before to clamp and fix the fixing pieces 61 to the outer periphery of the outer fixture 30. Thus, the polishing pad 10 is attached. Hence, the polishing pad 10 can easily be attached/detached without using any adhesive.

Figure 12A:
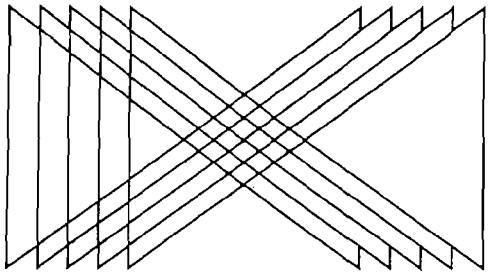
FIGS. 12A and 12B are views showing trackless polishing loci of the polishing apparatus.
Figure 12B:
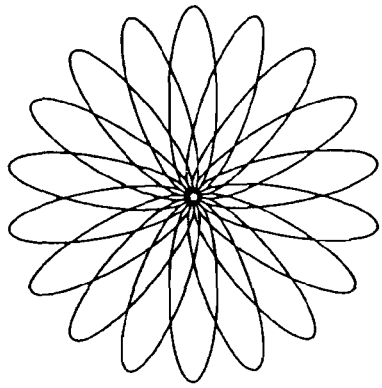

In the polishing apparatus 1 having the above structure, the lens 5 is attached to the lens attachment portion 6 of the arm 4 through the lens holding tool 7. The polishing jig 9 with the polishing pad 10 is attached to the upper surface of the swinging unit 8. The lens 5 is moved downward by the lifting unit 11 to press the concave surface 5*b* against the surface of the polishing pad 10. In this state, an abrasive is supplied to the surface of the polishing pad 10. At the same time, the swinging unit 8 is swiveled while reciprocally moving the arm 4 in the left-and-right and fore-and-aft directions. With these movements, the concave surface 5*b* of the lens 5 is polished by the polishing pad 10 and abrasive along a trackless polishing locus in which the polishing locus shifts little by little for each revolution, as shown in FIG. 12A or 12B, thereby finishing a desired toric surface. The polishing margin is about 5 to 9 μm. As the abrasive, a liquid abrasive prepared by dispersing an abrasive material (abrasive particles) such as aluminum oxide or diamond powder into an abrasive solution is used.

In polishing, since the concave surface 5*b* of the lens 5 cut by the curve generator contains, in cut marks, process steps due to backlash in NC control. The steps must be removed by polishing. When the steps should be removed by polishing, a suitable polishing force can be obtained by using a hard pad and an abrasive with a relatively large particle size. However, only with this, the surface roughness of polishing is limited because of the influence of particle size in polishing. To remove the cut marks by making a finer mirror surface, polishing is preferably performed twice under different polishing conditions (abrasive particle sizes and polishing times). More specifically, in the first polishing process, coarse polishing is executed by using an abrasive material with an average particle size of 1.4 to 3.0 μm and controlling the temperature to 8° C. to 14° C. The polishing time is 2 to 6 min, the polishing pressure is 5 to 400 mb, and the rotational speed is 400 to 1,000 rpm.

Next, the second polishing process is performed. In the second polishing process, the polishing pad 10 is replaced with a new pad, and finishing is executed using an abrasive material with an average particle size of 0.5 to 1.2 μm. The polishing time is about 30 sec to 1 min, the polishing pressure is 5 to 400 mb, and the rotational speed is 400 to 1,000 rpm. Aluminum oxide is used as the abrasive materials in the first and second polishing processes.

When the second polishing process is ended, visual inspection, dioptric power inspection using a lens meter, lens inner surface projection inspection using transmission light of a zircon lamp, and astigmatism optical performance inspection are performed. Thus, manufacturing of a toric lens is ended.

In the polishing jig 9 according to the present invention, the balloon member 25 is made of an elastic rubber material and formed into a cup shape having an elliptical shape when viewed from the front side. It is only necessary to expand the dome portion 25A by a fluid pressure and adjust the radius of curvature in accordance with the radius of curvature of the concave surface 5*b* of the lens 5. For this reason, the degree of freedom for the concave surface shape of the lens 5 is high. Since no different polishing jigs need be used in accordance with the curvature of the concave surface 5*b,* the number of polishing jigs 9 can be largely reduced as compared to conventional metal jigs. In addition, the dome portion 25A of the balloon member 25 is formed into an elliptical shape when viewed from the front side. For this reason, no means for suppressing expansion of the dome portion 25A by the fluid pressure need to be prepared to change the lengths of the major and minor axes. Since the structure of the polishing jig 9 itself is simpler and includes a smaller number of components than the polishing jig described Japanese Patent Laid-Open No. 2000-117604, the polishing jig can easily be handled.

Since the inner fixture 29 and outer fixture 30 clamp the inner flange 25C of the balloon member 25 and compress it in the direction of thickness, the interior of the balloon member 25 can be sealed in an airtight state by the inner flange 25C. In addition, since the lock portion 28 formed on the inner flange 25C is fitted in the annular groove 31*a* formed in the inner fixture 29, undesirable detachment of the balloon member 25 from the fixture 26 can be prevented even during polishing. To assemble the polishing jig 9, it is only necessary to fit and temporarily fix the balloon member 25 on the inner fixture 29, fit the inner fixture 29 in the depressed portion 36 of the outer fixture 30, and connect the inner fixture 29 and outer fixture 30 by the plurality of screws 37. Hence, the polishing jig 9 can easily be assembled.

The polishing pad 10 is formed from a sheet material made of polyurethane foam, felt, a fibrous fabric such as a non-woven fabric, or a synthetic resin. The fixing pieces 61 are detachably attached to the periphery of the polishing jig 9 by the clamping member 66 formed from a wire spring or coil spring. For this reason, the polishing pad 10 can easily be attached/detached to/from the polishing jig 9. The clamping member 66 is formed into a ring shape and fixes the fixing pieces 61 of the polishing pad 10 by the restoring force in the direction in which the diameter decreases. Hence, the clamping member 66 has a simple structure and can therefore easily be manufactured at a low cost. In addition, the clamping member 66 occupies only a small space and does not therefore impede polishing.

At the time of polishing, the balloon member 25 deforms due to the pressure that presses the polishing jig 9 against the concave surface 5*b* of the lens 5 or frictional resistance generated when the polishing jig 9 is moved relative to the lens 5. However, when the polishing pad 10 is attached to the polishing jig 9 by the clamping member 66 described above, the balloon member 25 is not undesirably detached from the clamping member 66 even when the fixing pieces 61 are slightly pulled out from the clamping member 66 in accordance with deformation of the balloon member 25. In addition, the fixing piece 61 is narrower than the outer peripheral portion of the petal piece. Hence, when the balloon member 25 deforms, the petal piece side deforms only in a small amount because the fixing piece 61 more easily deflects. Hence, no undesirable force that deforms the shape of the concave surface 5*b* is applied, and the surface can be satisfactorily polished.

Second Embodiment

Figure 13:
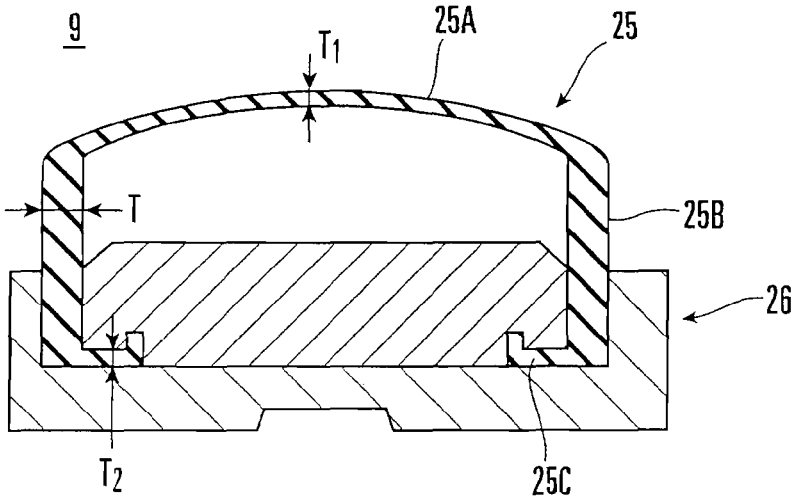
FIG. 13 is a view showing another embodiment of the present invention.

FIG. 13 shows another embodiment of the present invention.

In this embodiment, a plate thickness T of a cylinder portion 25B of a balloon member 25 is set to be larger than plate thicknesses T1 and T2 of a dome portion 25A and inner flange 25C. The remaining structures are the same as in the above-described first embodiment.

In this structure, since the plate thickness T of the cylinder portion 25B is large, and the rigidity increases, the shape holding ability is high. Hence, the dome portion 25A can be stably held, and deformation or expansion/contraction of the cylinder portion 25B due to sliding friction with respect to a lens 5 can be reduced or prevented.

Third Embodiment

Figure 14:
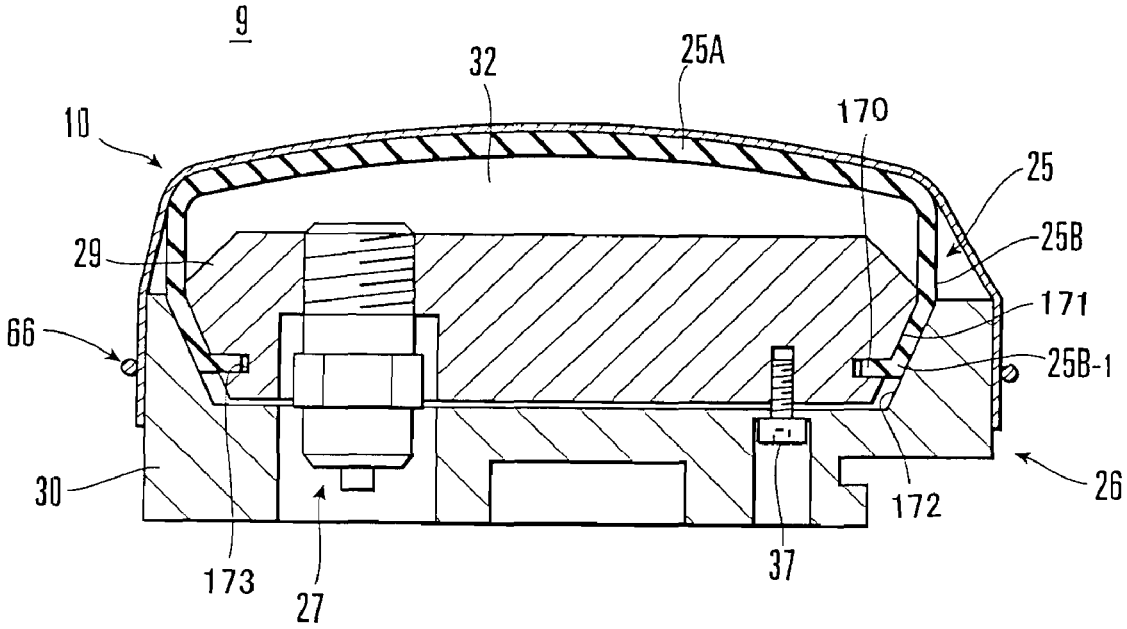
FIG. 14 is a view showing still another embodiment of the present invention.
Figure 15:
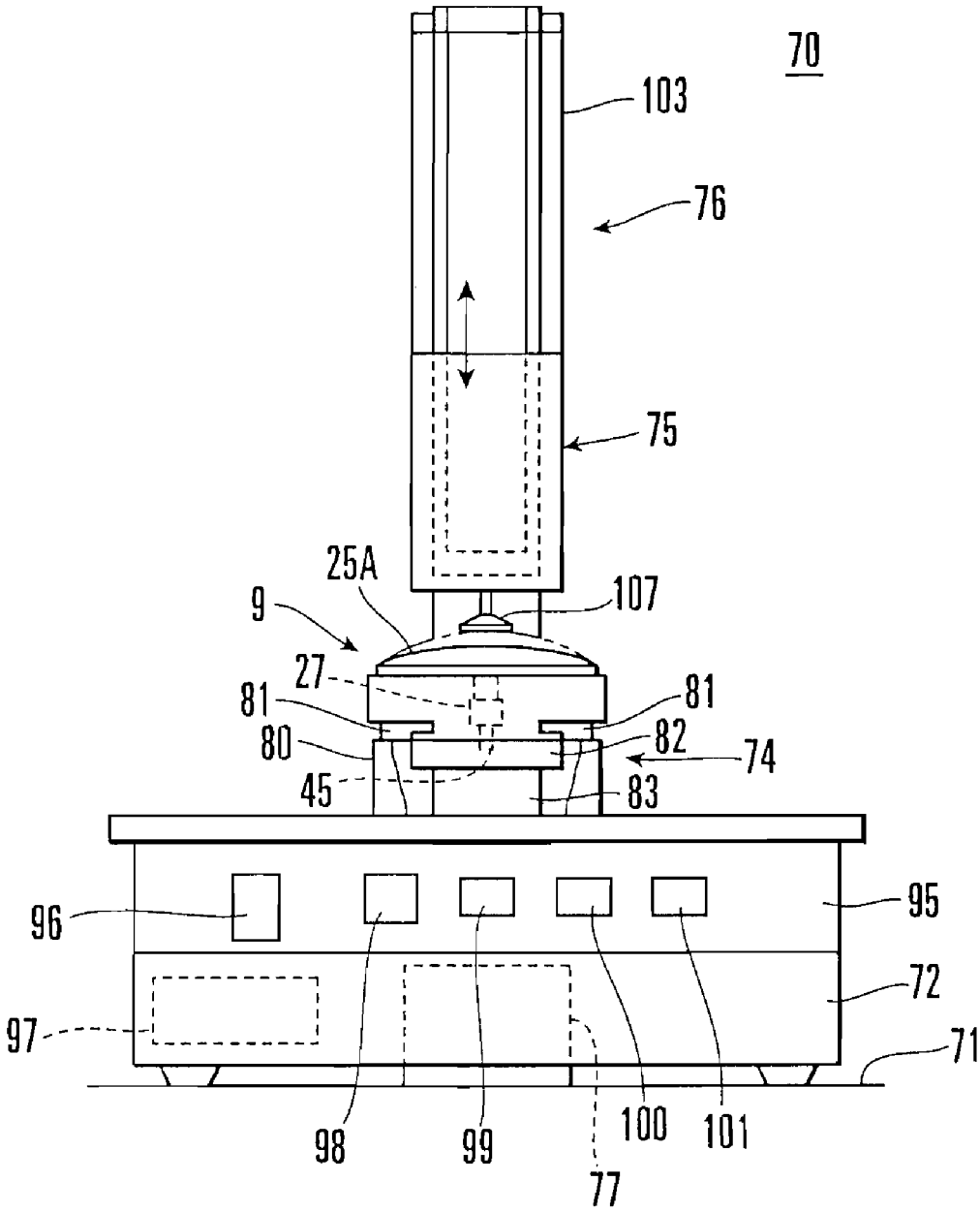
FIG. 15 is a front view showing the overall arrangement of a height measuring unit for a polishing apparatus dome portion with a polishing jig being attached to it.

FIG. 14 shows still another embodiment of the present invention.

In this embodiment, a balloon member 25 is constructed by a dome portion 25A and cylinder portion 25B. The cylinder portion 25B has, at its rear opening edge, a tapered cylinder portion 25B-1 inclined inward. An annular lock portion 170 bent inward is integrally formed at the end of the tapered cylinder portion 25B-1. The inner flange 25C shown in FIG. 7 is omitted. In addition, an inner fixture 29 and outer fixture 30 have, as their opposing walls, tapered portions 171 and 172 inclined at the same angle as that of the tapered cylinder portion 25B-1. The inner and outer surfaces of the tapered cylinder portion 25B-1 are sandwiched between the tapered portions 171 and 172. The lock portion 170 is fitted in an annular groove 173 formed in the tapered portion 171 of the inner fixture 29, thereby closing the rear opening portion of the balloon member 25. The remaining structures are the same as in the first embodiment shown in FIG. 7.

Even this structure can provide the same effect as in the first embodiment shown in FIG. 7.

In the above-described first to third embodiments, the balloon member 25 is formed into an elliptical shape when viewed from the front side, and the concave surface 5*b* as a toric surface of the spectacle lens 5 for correcting astigmatism is polished. However, the present invention is not limited to this and can also be used to polish a lens whose concave surface is formed from a spherical surface, aspherical surface, atoric surface, or free-form surface. The balloon member 25 need not always have an elliptical shape when viewed from the front side. The balloon member 25 may have a circular shape in accordance with the type of lens to be polished. Even when the lens concave surface is formed from an aspherical surface, atoric surface, or free-form surface with a complex shape, the balloon member deforms and follows the shape of the lens concave surface pressed against the balloon member because the balloon member is flexible. Hence, the lens surface can be polished.

In the first to third embodiments, air is used as a fluid to be supplied to the balloon member 25. Instead of air, a gas such as nitrogen or a liquid such as water may be used.

In the first to third embodiment, the valve 27 uses the ball 50 and exhaust pin 52. However, any other structure capable of supplying/exhausting the fluid and closing the hole can be used.

The polishing apparatus shown in the above-described first to third embodiments has the cup-shaped balloon member made of rubber. The dome portion can be formed into a desired shape in accordance with the curvature of the polished surface of an object to be polished only by the fluid pressure. For this reason, no different polishing jigs need be prepared in accordance with the shape of the polished surface. The number of polishing jigs can be largely decreased. Additionally, the curvature of the dome portion can easily be changed. Hence, the dome portion can easily be manufactured at a low cost without using any special means or components.

As shown in the first to third embodiments, when an inner flange is formed on the balloon member and clamped by the fixture, undesirable detachment of the balloon member from the fixture during polishing can be prevented.

As shown in the third embodiment, the same effect as described above can be obtained by forming a tapered cylinder portion at the rear opening edge of the cylinder portion of the balloon member and sandwiching the tapered cylinder portion by tapered portions formed on the inner and outer fixtures.

As in the second embodiment, when the cylinder portion of the balloon member is thick, the shape holding ability of the cylinder portion is high. Hence, deformation or expansion/contraction of the cylinder portion during polishing can be reduced.

As shown in the first to third embodiments, when a lock portion is formed on the rear opening portion side of the balloon member and locked by an annular groove formed in the inner fixture, the balloon member can be temporarily fixed to the inner fixture. This facilitates assembly of the polishing jig. In addition, undesirable detachment of the balloon member from the fixture is prevented during polishing. Also, it ensures the airtightness.

The polishing pad according to the present invention integrally has a plurality of fixing pieces. The fixing pieces are detachably fixed to the outer periphery of the polishing jig by a clamping member. With this structure, the polishing pad can easily be attached/detached in a short time without using adhesive. Furthermore, since the fixing piece portion deflects in accordance with deformation of the balloon member during polishing, deformation of the petal piece portion is small. Since no excessive force is applied to the polished surface during polishing, the surface can be satisfactorily polished.

The clamping member is formed from a wire spring having a ring shape and can therefore be manufactured at a low cost. The clamping member facilitates attachment/detachment of the polishing pad to/from the polishing jig. The clamping member occupies only a small space and does not impede polishing.

Fourth Embodiment

A curvature setting apparatus 70 for a dome portion used in a polishing apparatus according to the present invention will be described next with reference to FIGS. 15 to 23.

Referring to FIGS. 15 to 23, the curvature setting apparatus 70 has a box-shaped housing 72 installed on a workbench 71, and a column 73 (FIG. 16) that stands at the cross-direction center of the rear end of the upper surface of the housing 72. A jig convey unit 74 which reciprocally moves a polishing jig 9 in the fore-and-aft direction is arranged at the center of the upper surface of the housing 72. A height measuring unit 75 which measures the apex height of a dome portion 25A of a balloon member 25 (FIG. 7) of the polishing jig 9 is arranged in front of the column 73 through a lifting unit 76. An air supply unit (air compressor) 77 which supplies compressed air to the balloon member 25 is arranged behind the housing 72.

Figure 17:
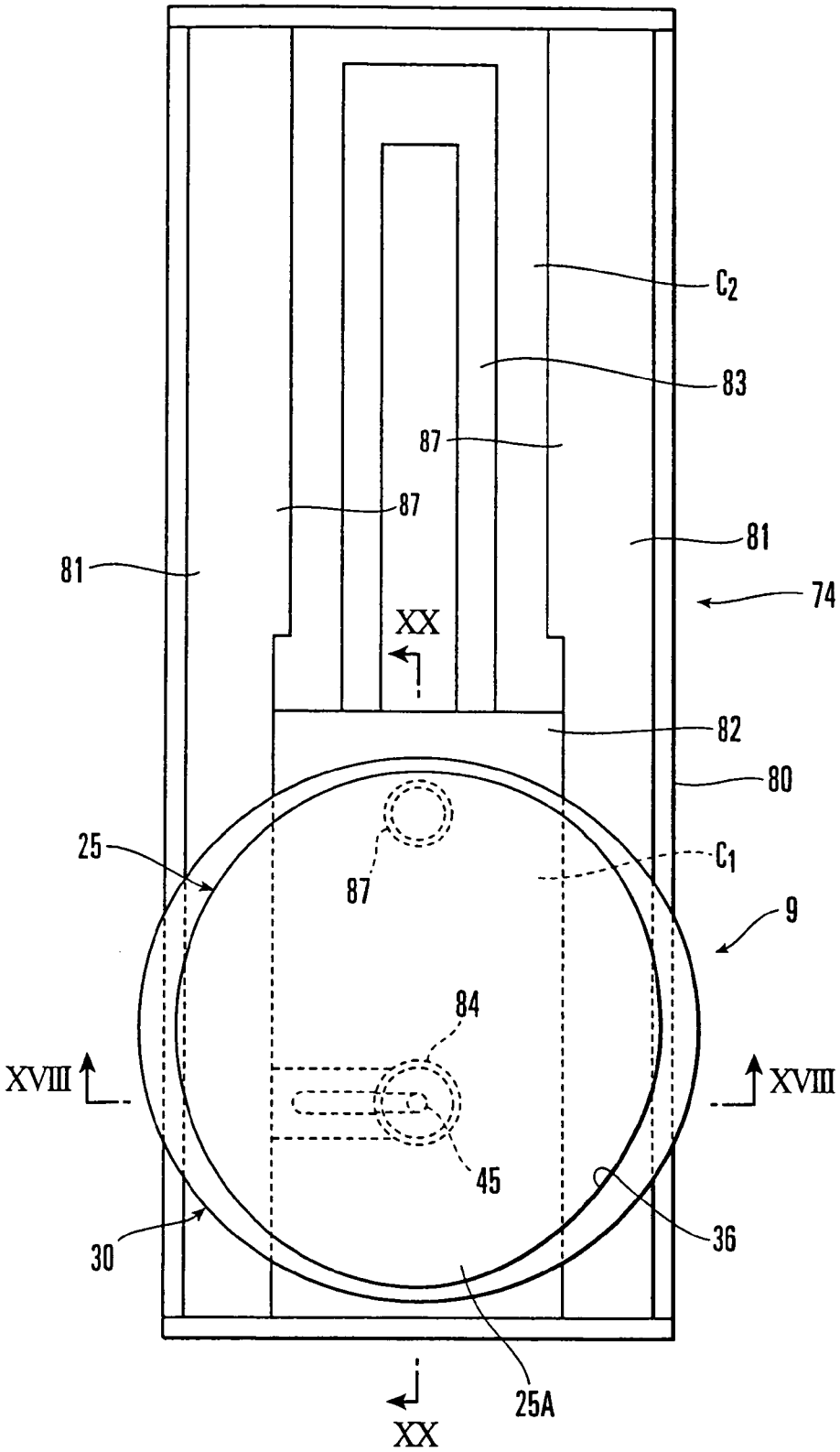
FIG. 17 is a plan view showing a state wherein the polishing jig is installed on an installation base.

As shown in FIG. 17 in detail, the jig convey unit 74 is constructed by a case 80 which has a box shape long in the fore-and-aft direction and an open upper surface, a pair of left and right guide rails 81 that parallelly run in the fore-and-aft direction on the case 80, an installation base 82 which is arranged in the case 80 to be movable in the fore-and-aft direction and on which the polishing jig 9 is installed, a driving unit 83 such as an air cylinder which reciprocally moves the installation base 82 between a jig attachment position C1 and a height measurement position C2, and a fluid supply port 45 formed in the installation base 82.

The pair of guide rails 81 are so long as to run full length of the case 80 in the fore-and-aft direction. The interval between the opposing surfaces of the guide rails 81 at the fore part is set to be slightly larger than the width of a base portion 30C projecting to the bottom surface of an outer fixture 30. At the rear part, guide portions 87 (FIG. 17) formed from projecting portions are integrated with the guide rails 81 in correspondence with engaging grooves 38' of the outer fixture 30 shown in FIG. 6.

Figure 18:
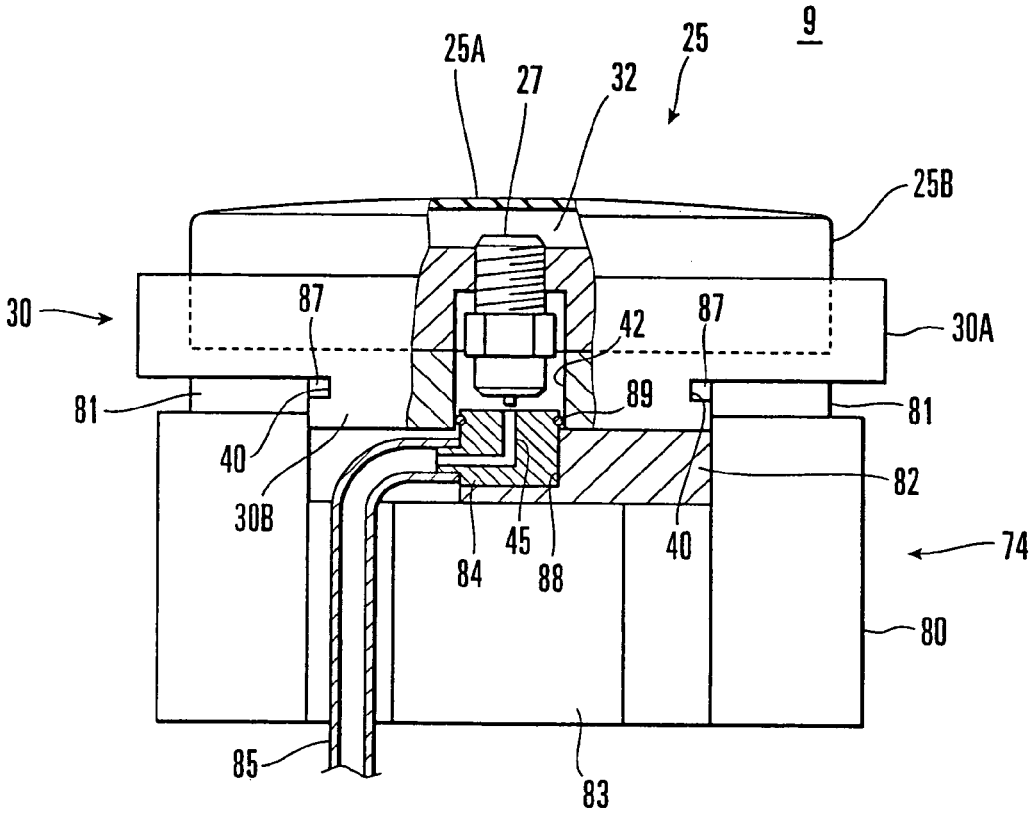
FIG. 18 is a view showing a partially cutaway state along a line XVIII—XVIII in FIG. 17.
Figure 19:
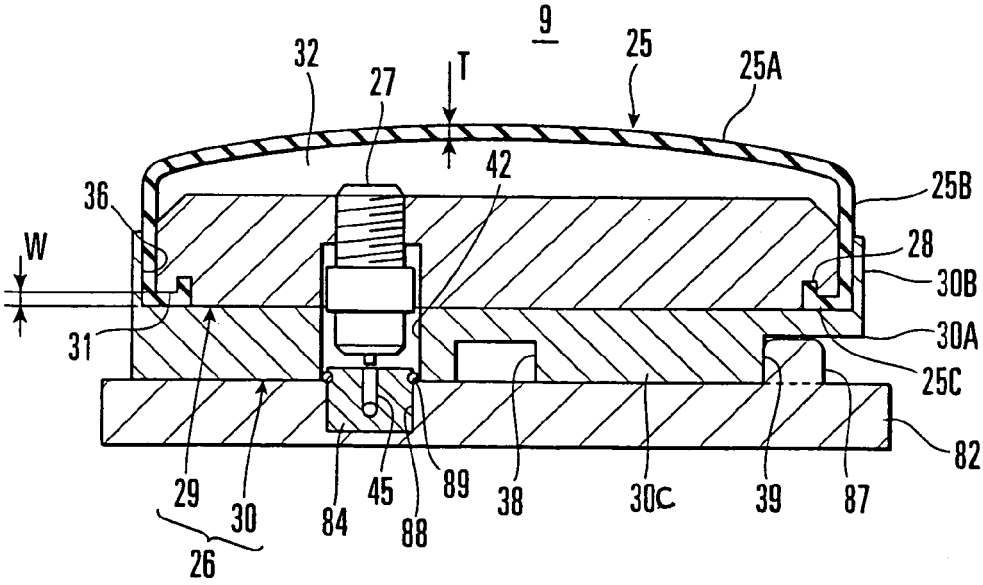
FIG. 19 is a view showing a partially cutaway state along a line XX—XX in FIG. 17.

As shown in FIGS. 17, 18, and 19, the installation base 82 has a fluid supply port forming member 84 in the upper surface. In addition, a positioning pin 87 for positioning the polishing jig 9 projects from the installation base 82. The fluid supply port forming member 84 is fitted in a recess portion 88 formed in the upper surface of the installation base 82 while making the upper end portion project upward from the installation base 82. A through hole 42 of the outer fixture 30 is fitted on the outer peripheral surface of the upper end portion of the fluid supply port forming member 84 via an O-ring 89.

As shown in FIG. 17, the positioning pin 87 projects near the rear end of the installation base 82. When the polishing jig 9 is installed on the installation base 82, the positioning pin 87 is inserted into a positioning recess portion 39. As the recess portion 39 engages with the positioning pin 87, and the fluid supply port forming member 84 is fitted in the through hole 42, the polishing jig 9 is positioned in the left-and-right and fore-and-aft directions with respect to the installation base 82.

Figure 22A:
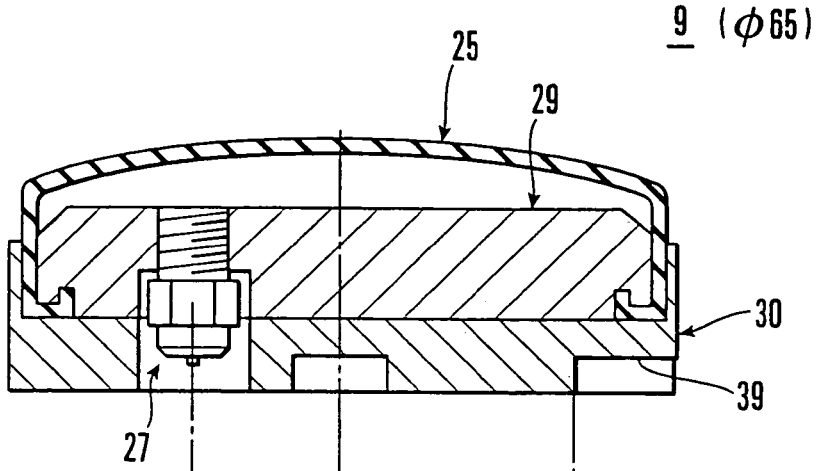
FIGS. 22A and 22B are views showing the relationship between the polishing jig and the installation base of the height measuring unit for the dome portion.
Figure 22B:
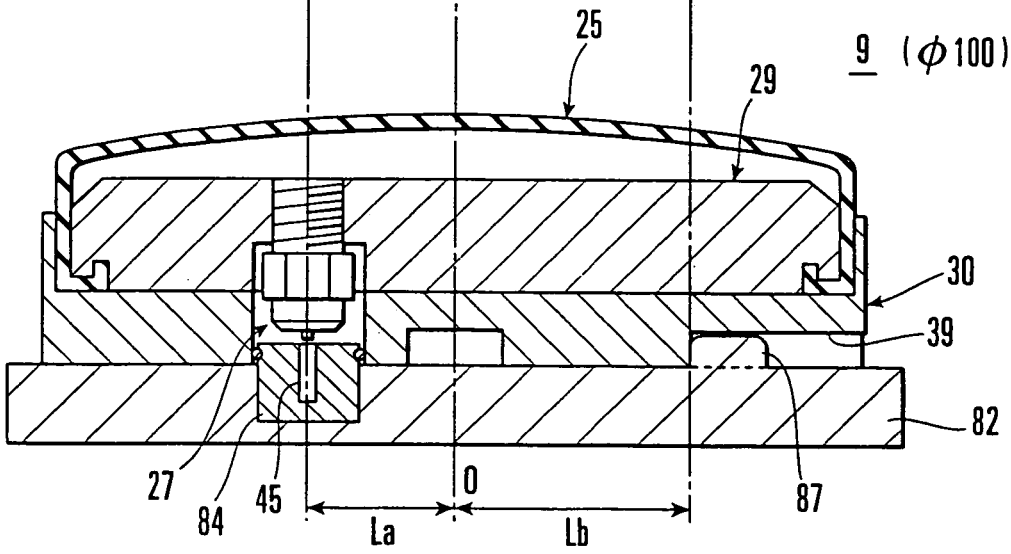

The installation base 82 is commonly used to all polishing jigs 9 whose balloon members 25 have different major axis lengths of, e.g., 65, 70, . . . , 100 mm. For this purpose, in all polishing jigs 9 having different sizes, a distance La from a center O of the polishing jig 9 to the center of the valve 27 and a distance Lb from the center O to the positioning recess portion 39 are set to equal the distance from the center of the installation base 82 to the center of the fluid supply port forming member 84 and the distance from the center of the installation base 82 to the positioning pin 87, respectively, as shown in FIGS. 22A and 22B. This aims at making the centers of all polishing jigs 9 coincide with the center of the installation base 82 and, when the installation base 82 is moved to the height measurement position C2, making the center of the polishing jig 9 coincide with the center of the height measuring unit 75. FIG. 22A shows a polishing jig whose major axis is 80 mm long. FIG. 22B shows a polishing jig whose major axis is 100 mm long.

The installation base 82 is normally located at the jig attachment position C1, i.e., the stop position on the front side. The polishing jig 9 is installed from the upper side. The height measurement position C2 is a stop position on the rear side of the jig attachment position C1. At the height measurement position C2, the center of the polishing jig 9 installed on the installation base 82 and, more strictly, the apex of the dome portion 25A of the balloon member 25 is located immediately under the height measuring unit 75.

An operation unit 95 is arranged in front of the housing 72. The operation unit 95 has, on its surface, a power switch 96, a height data input means 98 for inputting the apex height of the dome portion 25A of the balloon member 25 to a control section 97 in accordance with the instruction for a lens 5, a start button 99, a pause button 100, an indicator lamp 101, and the like. In this embodiment, an operation button is used as the height data input means 98. However, the present invention is not limited to this. Data may be input through a keyboard, a barcode reader, an external computer, or a network.

Figure 16:
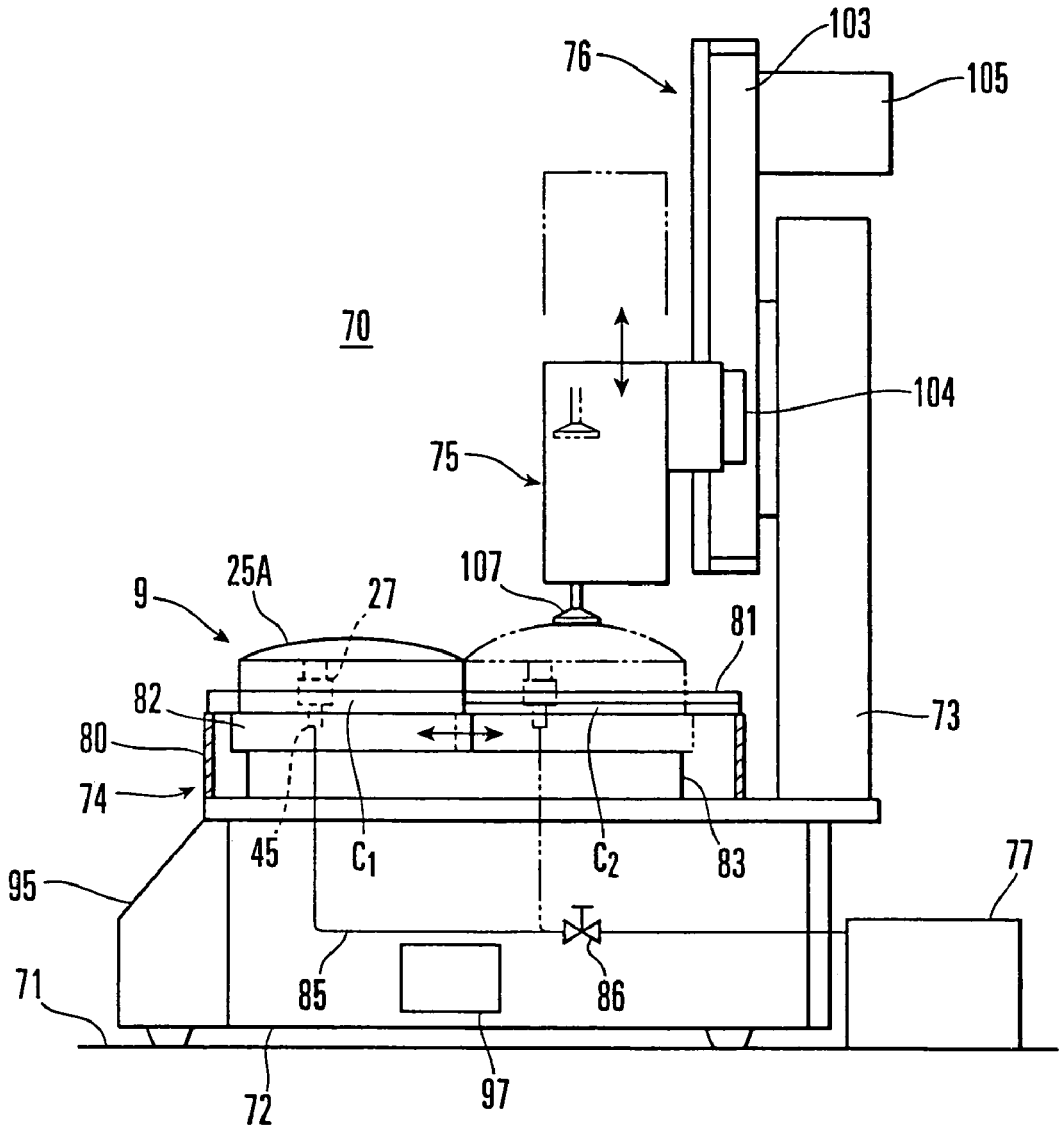
FIG. 16 is a side view showing a state wherein the polishing jig is attached to the height measuring unit for the dome portion shown in FIG. 15.

As shown in FIGS. 16 and 17, the lifting unit 76 is constructed by a Z-axis guide 103 vertically attached to the front surface of the column 73, a slider 104 attached to the Z-axis guide 103 to be movable in the vertical direction, and a driving unit 105 such as a motor which vertically moves the slider 104. The height measuring unit 75 is attached to the front surface of the slider 104. The height measuring unit 75 has a height detection means 107 on the lower side. The height measuring unit 75 is designed to detect the apex height of the dome portion 25A of the polishing jig 9 by the height detection means 107 and send the detection signal to the control section 97. As the height detection means 107, a sensor for detecting the apex height of the dome portion 25A by a contact pressure is used. Instead, an optical sensor which performs noncontact detection may be used. The control section 97 has a function of changing the height of the height measuring unit 75 in accordance with input apex height data and a function of controlling air supply by opening/closing a valve 86 in accordance with the detection signal from the height detection means 107.

Figure 20:
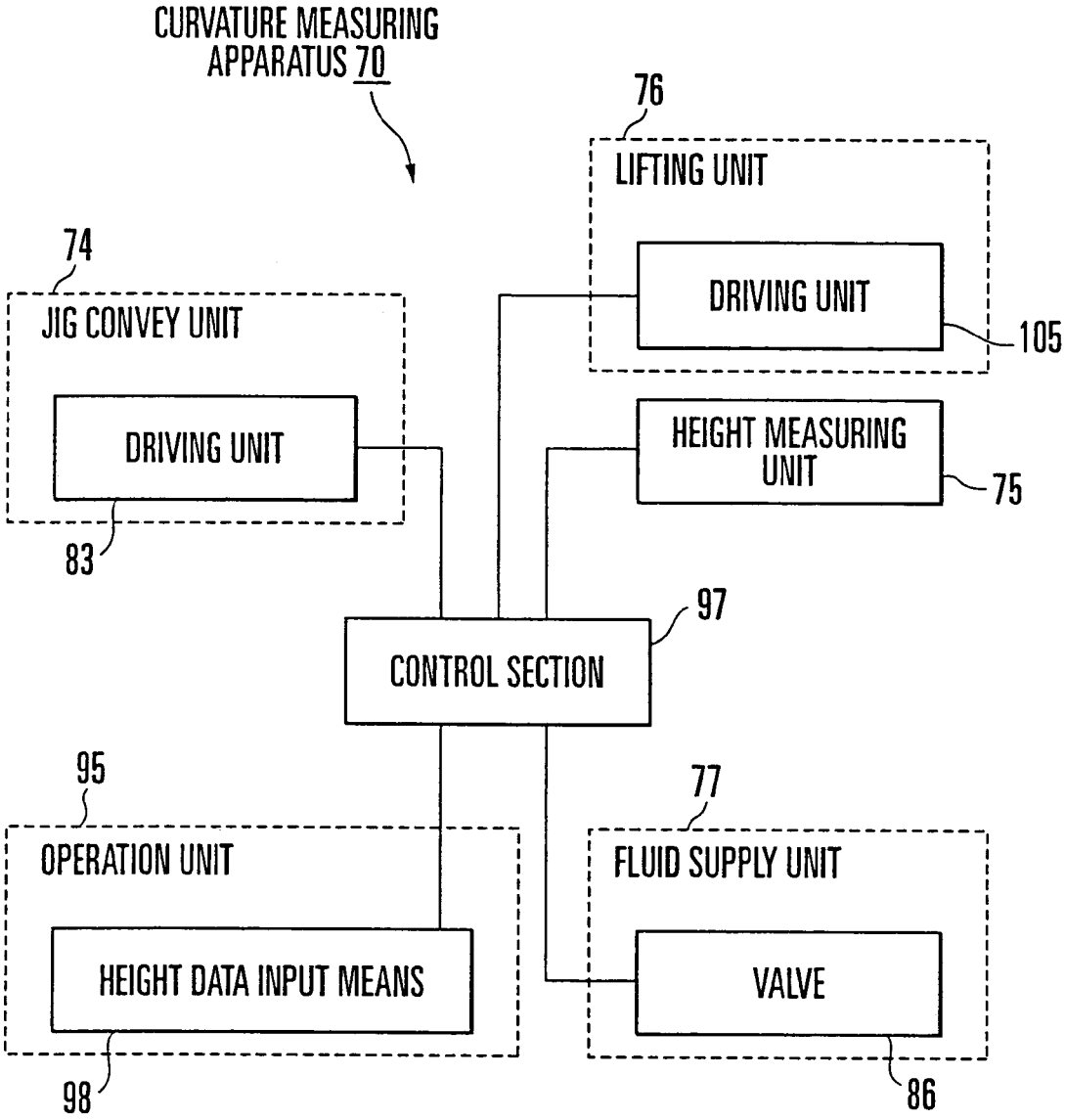
FIG. 20 is a block diagram showing the system configuration of the curvature setting apparatus for the polishing apparatus dome portion.
Figure 21:
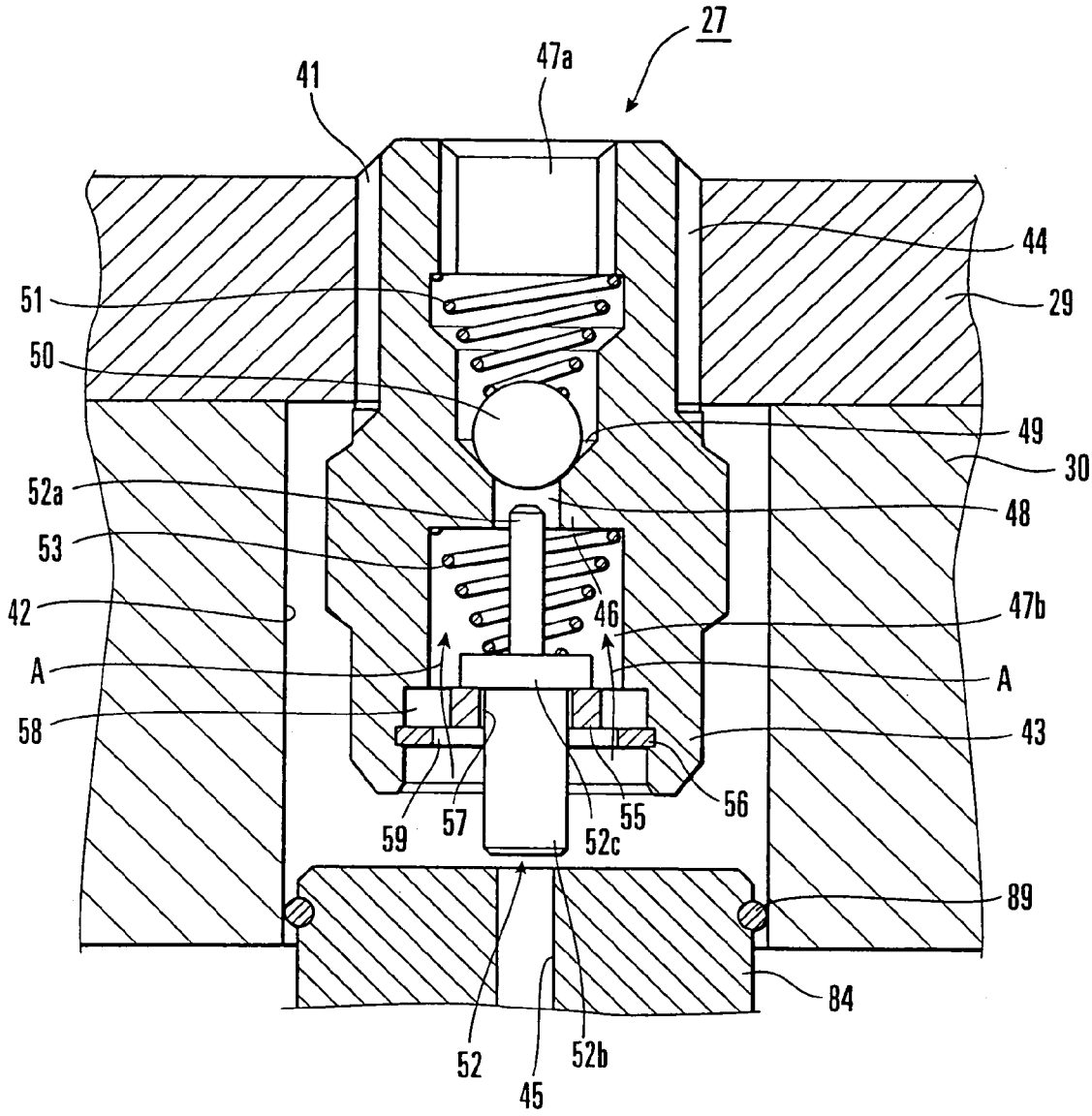
FIG. 21 is a sectional view showing a valve attached to the polishing jig.

FIG. 20 shows the system configuration of the above-described curvature setting apparatus for the polishing apparatus dome portion.

Figure 23:
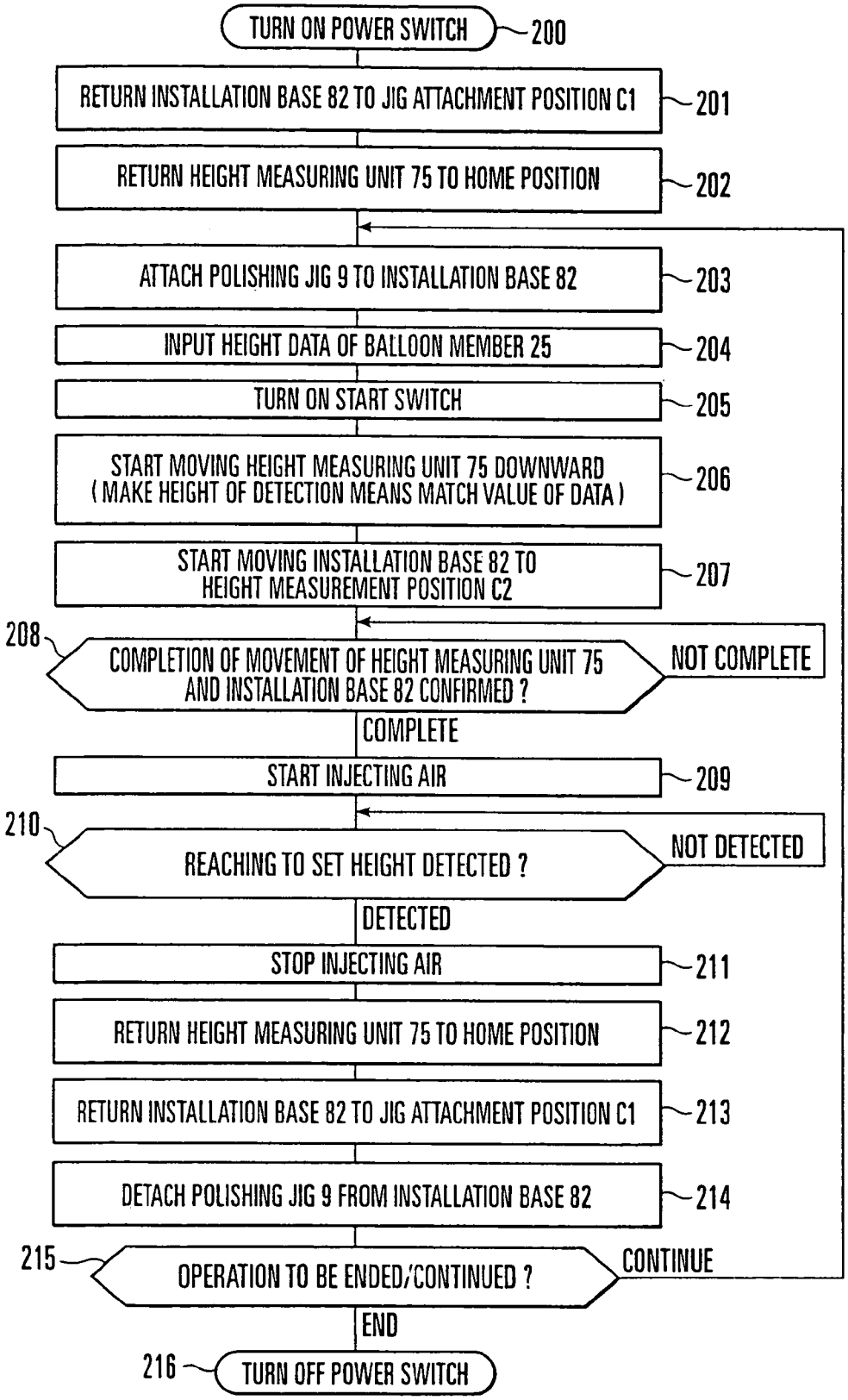
FIG. 23 is a flow chart showing a procedure for measuring the height of the balloon member by the height measuring unit for the dome portion.

A curvature setting method and the procedure of curvature setting operation for the balloon member 25 by the curvature setting apparatus 70 will be described next on the basis of the flow chart shown in FIG. 23.

Before the start of operation, the height of the reference surface (upper surface of the installation base 82) is set to zero in advance. Next, the power switch 96 is turned on (step S200) to return the installation base 82 from the height measurement position C2 to the jig attachment position C1 (step S201). Then, the height measuring unit 75 is returned to the home position (step S202).

The polishing jig 9 described in the process instruction field of the instruction for the lens 5 to be polished is selected and installed on the installation base 82. At this time, the balloon member 25 has no polishing pad 10 yet. To install the polishing jig 9 on the installation base 82, the polishing jig 9 is placed on the installation base 82 from the upper side, the fluid supply port forming member 84 is fitted in the through hole 42 via the O-ring 89, and the positioning recess portion 39 is engaged with the positioning pin 87, as shown in FIG. 19. Accordingly, the valve 27 is connected to the fluid supply port 45 (step S203) to make it possible to supply compressed air to the balloon member 25. The data of the apex height of the balloon member 25 of the polishing jig 9 installed on the installation base 82 is checked in accordance with the instruction and input to the control section 97 through the height data input means 98 (step S204).

When data input and installation of the polishing jig 9 on the installation base 82 are ended, the start button 99 is operated (step S205). The lifting unit 76 is driven, and the height measuring unit 75 starts moving downward along the Z-axis guide 103 (step S206). The height measuring unit 75 moves downward until the height of the height detection means 107 equals the apex height data input to the control section 97. Almost simultaneously when the height measuring unit 75 starts moving downward, the driving unit 83 starts driving and moving the installation base 82 from the jig attachment position C1 to the height measurement position C2 (step S207). In accordance with this movement, the guide portions 87 of the guide rails 81 are inserted to the engaging grooves 38'.

When it is confirmed that the height measuring unit 75 and the installation base 82 with the polishing jig 9 have completely moved to the height measurement position C2 (step S208), the valve 86 is opened in accordance with a signal from the control section 97 to start injecting air from the air supply unit 77 to the balloon member 25 (step S209). When compressed air is supplied to the balloon member 25, the dome portion 25A gradually expands and increases its apex height along with an increase in pressure in a sealed space 32. When the apex height equals a predetermined height, i.e., the value input to the control section 97, the height detection means 107 detects the height (step S210). The height measuring unit 75 sends the detection signal to the control section 97. On the basis of the detection signal, the control section 97 closes the valve 86 to stop compressed air supply from the air supply unit 77 (step S211).

After that, the height measuring unit 75 is returned to the home position (step S212). The installation base 82 is returned to the jig attachment position C1 (step S213). The polishing jig 9 is detached from the installation base 82 (step S214). The curvature setting operation for the balloon member 25 by the curvature setting apparatus 70 is thus ended (step S215). The power switch is turned off (step S216). To continue the curvature setting operation, operation from step S203 is repeated.

In this curvature setting apparatus 70, since the apex height of the dome portion 25A of the balloon member 25 is measured, a height change as small as about 0.1 mm can be measured. Even when the balloon member 25 has degraded due to a change over time, the curvature based on the apex height can be measured only by expanding the dome portion 25A until the apex height of the dome portion 25A matches the data input to the control section 97. Hence, the influence of degradation of the balloon member 25 can be reduced as compared to a method of measuring the internal pressure of the dome portion 25A, and the dome portion 25A can easily obtain a curvature close to that of a concave surface 5*b* of the lens 5.

The operator only needs to install the polishing jig 9 on the installation base 82, input the apex height data to the control section 97, and operate the height data input means 98. Since conveyance of the polishing jig 9 by the installation base 82, supply/stop of compressed air, and measurement of the apex height are automatically done, the load on the operator is reduced.

The jig attachment position C1 and height measurement position C2 are connected by the jig convey unit 74. When the polishing jig 9 is installed on the installation base 82 at the jig attachment position C1, the polishing jig 9 is conveyed to the height measurement position C2. This reduces the load on the operator, and he/she never undesirably hits the polishing jig 9 against the height detection means 107.

When the curvature setting apparatus 70 has set the curvature of the dome portion 25A of the balloon member 25 to a predetermined value by supplying compressed air, the polishing jig 9 is detached from the curvature setting apparatus 70. The polishing pad 10 is attached to the dome portion 25A. Then, the polishing jig 9 is attached to a swinging unit 8 of a polishing apparatus 1, and the concave surface of the lens 5 is polished by the polishing pad 10. More specifically, the lens 5 is attached to a lens attachment portion 6 of an arm 4 through a lens holding tool 7. The polishing jig 9 with the polishing pad 10 is attached to the swinging unit 8. The lens 5 is moved downward by a lifting unit 11 to press the concave surface 5*b* against the surface of the polishing pad 10.

In this state, an abrasive is supplied to the surface of the polishing pad 10. At the same time, the swinging unit 8 is swiveled while reciprocally moving the arm 4 in the left-and-right and fore-and-aft directions. With these movements, the concave surface 5*b* of the lens 5 is polished by the polishing pad 10 and abrasive along a trackless polishing locus in which the polishing locus shifts little by little for each revolution, as shown in FIG. 12A or 12B, thereby finishing a desired toric surface. The polishing margin is about 5 to 9 μm. As the abrasive, a liquid abrasive prepared by dispersing an abrasive material (abrasive particles) such as aluminum oxide or diamond powder into an abrasive solution (e.g., aqueous nitric acid solution) is used.

In the above-described fourth embodiment, the curvature setting apparatus 70 is designed to reciprocally move the polishing jig 9 between the jig attachment position C1 and the height measurement position C2 using the installation base 82. However, the present invention is not limited to this. Instead of the reciprocally movable installation base 82, a stationary installation base on which the polishing jig 9 is installed at the height measurement position C2 may be used. In this case, since the jig convey unit 74 is unnecessary, the number of components can be deceased, and the entire apparatus can be simplified. Additionally, the apparatus is easy to control and can be made compact and lightweight.

In the above-described fourth embodiment, air is used as the fluid to be supplied to the polishing jig 9. Instead, a gas such as nitrogen or a liquid such as water may be used.

In the above-described fourth embodiment, for air supply, only the function of only supplying/stopping air (opening/closing the valve 86) is imparted to the control section 97 to simplify the structure. Instead, the radius of curvature of the dome portion 25A of the balloon member 25 may be made smaller than the input data by supplying air more than a predetermined amount, and the radius of curvature of the dome portion 25A may then be increased until it matches the input data while exhausting the air from the dome portion 25A.

In the above-described fourth embodiment, an apparatus other than the above-described curvature setting apparatus 70 may be used to execute the curvature setting method. For example, an apparatus with another height detection means may be used.

In the above-described fourth embodiment, the present invention is applied to the polishing jig 9 whose balloon member 25 has an elliptical shape when viewed from the front side, and the concave surface 5*b* formed from a toric lens of the spectacle lens 5 for correcting astigmatism is polished. However, the present invention is not limited to this and can be applied to a polishing jig having a circular shape when viewed from the front side. The present invention can also be applied to a polishing jig to be used to polish a concave surface of a lens such as a spherical lens, an aspherical lens, an atoric lens, or a progressive-power lens having a free-form surface.

As described above, in the height measuring unit for the polishing apparatus dome portion and the method therefor shown in the fourth embodiment, it is determined by measuring the apex height of the dome portion of the balloon member whether the curvature of the dome portion has reached a predetermined value. For this reason, a small change in height can be measured. In addition, since degradation of the balloon member due to a change over time has no influence, the curvature of the dome portion can be made to coincide with that of the concave surface of the lens at an accuracy higher than that in measuring the internal pressure of the dome portion. Furthermore, since the apparatus can easily be handled, and fluid supply to the balloon member and apex height measurement can automatically be executed, the load on the operator can be reduced.

Fifth Embodiment

FIGS. 24 to 28 show still another embodiment of the present invention, which is related to the lens holding tool of a polishing apparatus. The same reference numerals as in the above-described embodiments denote the same parts or parts having the same functions in this embodiment.

In this embodiment, the present invention is applied to cut and polish a concave surface formed from a toric surface of a plastic spectacle lens for correcting astigmatism. As a lens 5 to be cut and polished, a semifinished lens which is formed from an urethane- or epithio-based resin with a high refractive index (n=1.55 to 1.75) and for which only the convex surface is finished is used.

To manufacture the lens, as described above, a lens holding tool 7 is attached to a convex surface 5*a* of the lens 5 first. The lens 5 is attached to a curve generator through the lens holding tool 7, and a concave surface 5*b* of the lens 5 is cut into a predetermined shape. Then, the lens 5 is attached to the polishing apparatus through the lens holding tool 7, and the cut surface is polished.

Figure 24:
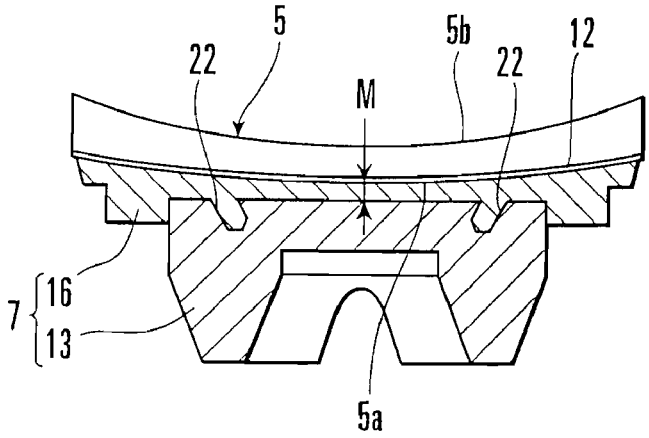
FIG. 24 is a sectional view showing a state wherein a lens holding tool is attached to a lens in still another embodiment of the present invention.

To attach the lens 5 to the lens holding tool 7, a protective film 12 for preventing flaws is bonded to the convex surface 5*a* of the lens 5 in advance, as shown in FIG. 24. The lens holding tool 7 is attached onto the protective film 12 using, e.g., a device called a layout blocker available from LOH. Four kinds of lenses 5 with diameters of 80, 75, 70, and 65 [mm] are used.

Figure 25:
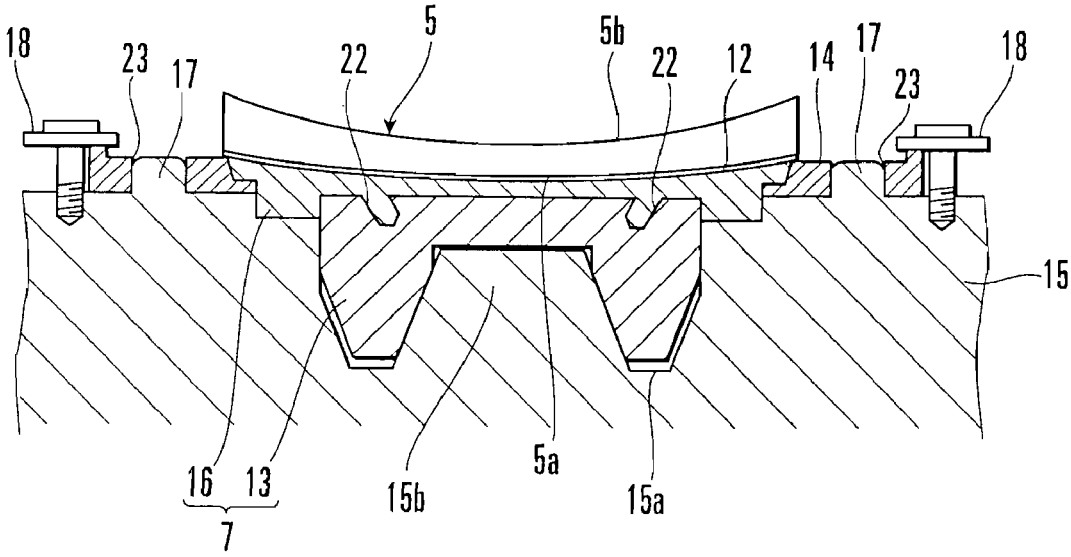
FIG. 25 is a sectional view showing a state wherein the lens holding tool is attached to the lens by a layout blocker.

Referring to FIGS. 24 to 26, the lens holding tool 7 is constructed by a lens holder unit 13 and an alloy layer 16 made of a low-melting alloy. The lens holder unit 13 and a blocking ring 14 placed around the lens holder unit 13 are fitted in a mount 15 of the layout blocker. The lens 5 having the protective film 12 bonded thereto and the convex surface 5*a* facing down is placed on the blocking ring 14. The molten alloy layer 16 is supplied into the space formed by the lens 5, lens holder unit 13, blocking ring 14, and mount 15 and hardened. As shown in FIG. 24 in detail, on the lens 5 side, the alloy layer 16 is in contact with almost the entire back surface of the lens 5. On the lens holder unit 13 side, the alloy layer 16 projects to the outside portion of the lens holder unit 13.

The integral structure formed from the lens 5, lens holder unit 13, blocking ring 14, and alloy layer 16 is detached from the mount 15. Then, the blocking ring 14 is detached. Accordingly, the lens 5 is held by the lens holding tool 7 constructed by the lens holder unit 13 and alloy layer 16. The mount 15 in which the lens holder unit 13 is fitted tilts down to the front side at an angle of 40° to 45° to make the alloy layer 16 easily flow.

The structures of the lens holder unit 13 and blocking ring 14 will be described in more detail with reference to FIGS. 26A, 26B, 26C, 27A, and 27B.

Figure 26A:
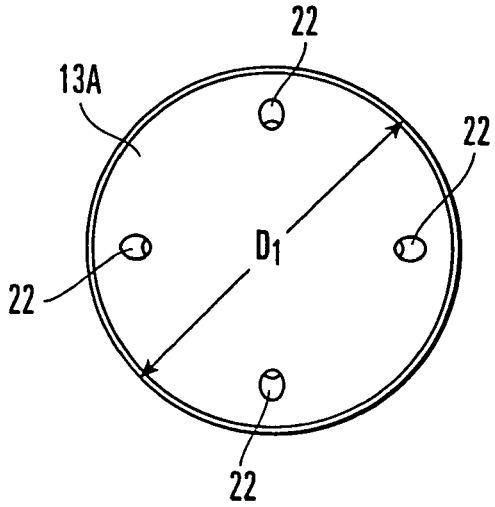
FIGS. 26A, 26B, and 26C are plan, sectional, and bottom views, respectively, of a lens holder unit.
Figure 26B:
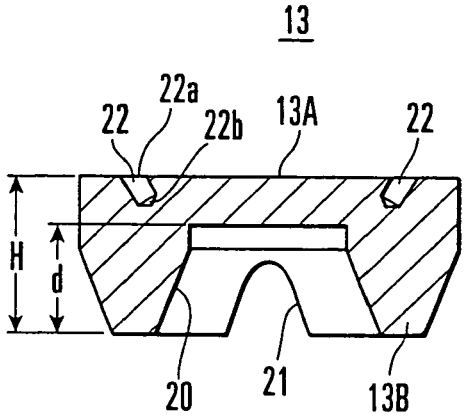
Figure 26C:
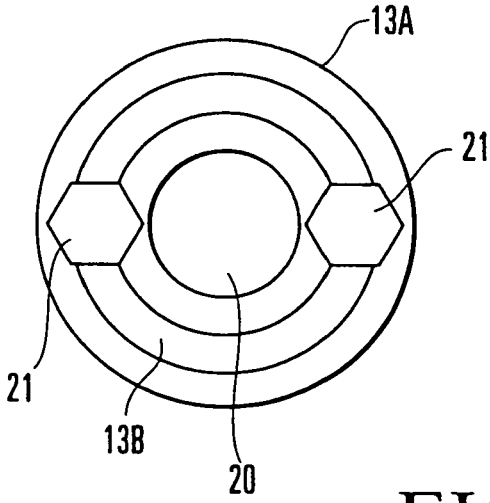

Referring to FIGS. 26A to 26C, the lens holder unit 13 formed into a cup shape by SUS303 or the like is constructed by a disk portion 13A and an annular projection 13B which has a trapezoidal sectional shape and integrated with the peripheral portion of the lower surface of the disk portion 13A. The upper surface of the disk portion 13A is flat. The annular projection 13B has a depressed portion 20 inside. Two positioning recess portions 21 are formed in the annular projection 13B while being separated by 180° in the circumferential direction. The annular projection 13B is fitted in an annular recess portion 15*a* (FIG. 25) formed in the upper surface of the mount 15. A projecting portion 15*b* having a truncated conical shape fitted in the depressed portion 20 is integrally formed at the center of the annular recess portion 15*a*. Two positioning portions (not shown) fitted in the positioning recess portions 21 are integrally formed on the groove bottom of the annular recess portion 15*a*.

A plurality of lens holder units 13 having different heights H are prepared such that a central thickness M (FIG. 24) of the alloy layer 16 falls within a predetermined range. In this embodiment, seven lens holder units 13 having the different heights H are used, as shown in FIG. 28 (to be described later).

The lens holder unit 13 has a predetermined diameter D1 set to, e.g., 43 mm independently of the difference in diameter or base curve (BC) of the lens 5. The depressed portion 20 formed at the center of the lower surface of the lens holder unit 13 has the same size and depth for all lens holder units such that the depressed portion 20 is suitable for the projecting portion 15*b* of the mount 15 (for example, depth d=15 mm). Four blind holes (holes each closed at one end) 22 each having a diameter of about 4 mm and a depth of about 7 mm are formed on the peripheral side of the upper surface of the lens holder unit 13 at equal intervals in the circumferential direction. The four blind holes 22 are non-through holes tilted by about 600 in the radial direction of the lens holder unit 13 such that opening portions 22*a* are located close to the periphery of the lens holder unit 13 while internal end portions 22*b* are located close to the center of the lens holder unit 13. The holes 22 have different tilt directions. Since the alloy layer 16 that has entered the holes 22 and hardened is connected to the lens holder unit 13 firmly in all directions, undesirable removal, detachment, or rotation of the alloy layer 16 from the lens holder unit 13 can be prevented. In addition, since the opening portions 22*a* are located close to the periphery of the lens holder unit 13, the amount of the alloy layer 16 is small at the center of the lens holder unit 13. Hence, deformation of the lens due to shrinkage of the alloy layer 16 can be reduced.

Figure 27A:
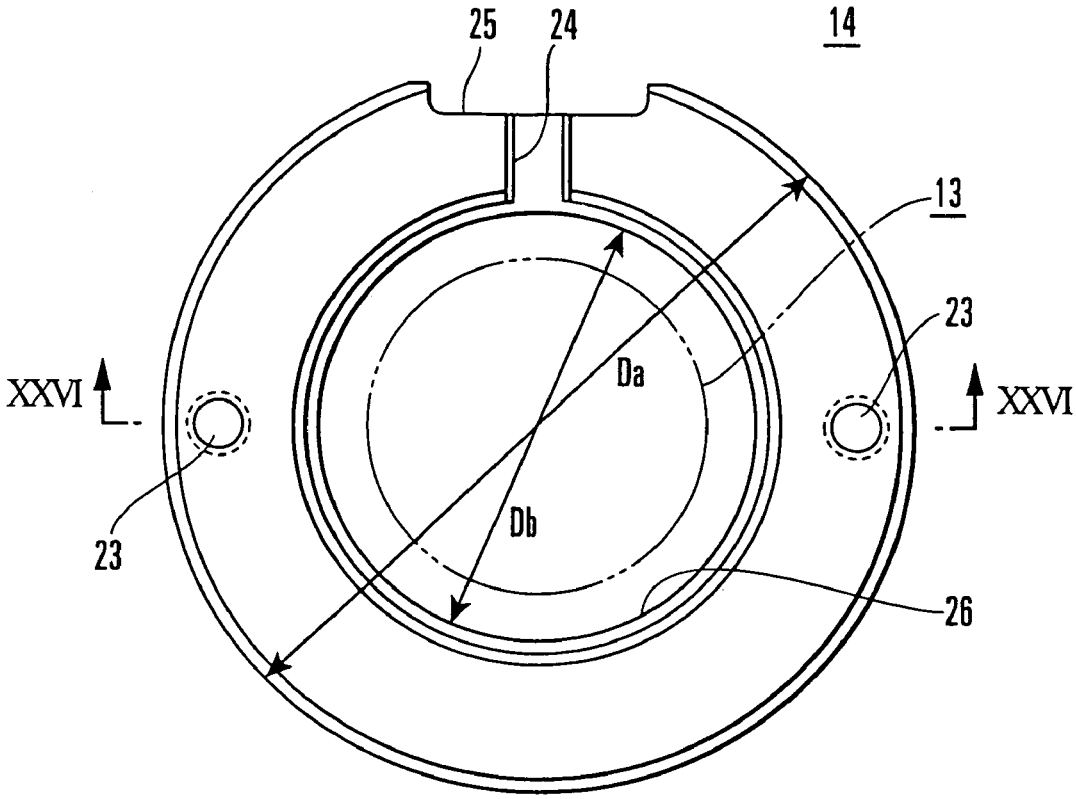
FIGS. 27A and 27B are a plan view of a blocking ring and a sectional view taken along a line XXVI—XXVI, respectively.
Figure 27B:
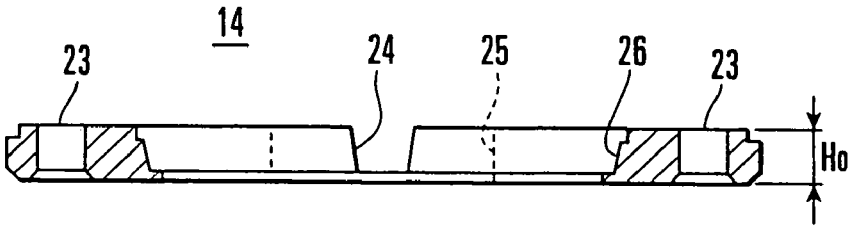

Referring to FIGS. 27A and 27B, the blocking ring 14 is made of SUS303 or the like, like the lens holder unit 13. The blocking ring 14 has a predetermined inner diameter and height corresponding to the diameter and BC of the lens 5. An outer diameter Da of the blocking ring 14 is larger than the diameter of each of the lenses 5 having different diameters. An inner diameter Db is set to almost equal the diameter of the lens 5 (strictly speaking, the inner diameter Db is smaller than the lens diameter by about 2 mm). A height HO changes in correspondence with the BC of the lens 5. In this embodiment, six blocking rings 14 having different inner diameters Db (four diameters) and different heights H0 (two heights) are used (one blocking ring height for 80- and 75-mm diameter lenses each).

The blocking ring 14 has two positioning holes 23, an alloy channel 24, and an alloy injection port 25. The two positioning holes 23 are through holes which are open to the upper and lower surfaces of the blocking ring 14 and are separated at equal intervals in the circumferential direction of the blocking ring 14. The alloy channel 24 is formed from a groove in the radial direction, which is formed at a position separated from the two positioning holes 23 at an equidistance on the upper surface of the blocking ring 14. The outer end of the alloy channel 24 communicates with the alloy injection port 25, and the inner end communicates with a center hole 26 of the blocking ring 14. The alloy injection port 25 is formed from a recess portion formed in the outer periphery of the blocking ring 14.

When the lens holder unit 13 is set in the mount 15, the blocking ring 14 is positioned to the mount 15 as the positioning holes 23 are fitted on positioning pins 17 (FIG. 25) projecting from the upper surface of the mount 15. When the blocking ring 14 is fixed by fixtures 18 such as bolts, the alloy injection port 25 is connected to the alloy supply port of the layout blocker, so the blocking ring 14 surrounds the lens holder unit 13.

The lens 5 with the convex surface 5*a* facing down is set on and pressed against the blocking ring 14 by an appropriate press member. In this state, the molten alloy layer 16 is supplied to the alloy injection port 25. Since the mount 15 tilts down to the front side, the alloy layer 16 is injected to the center hole 26 of the blocking ring 14 through the alloy channel 24, supplied to the upper surface and outer periphery of the lens holder unit 13, and cooled and hardened to fix the lens 5 to the lens holder unit 13. The lens holder unit 13 and blocking ring 14 to be used are appropriately selected in accordance with the diameter and BC of the lens 5. In this embodiment, the lens holder unit 13 and blocking ring 14 are selected in accordance with FIGS. 28A to 28D. For example, when the lens 5 having a diameter of 70 mm and a BC of 3.0 is to be polished, the lens holder unit 13 having a height of 18.5 mm and the blocking ring 14 having an inner diameter of 68 mm and a height of 7 mm are selected in accordance with FIG. 28C.

FIGS. 28A to 28D show the dimensional relationships between the types of lenses 5, the types of blocking rings 14, the types of lens holder units 13, and the gaps between the lens centers and the lens holder units (=central thicknesses of the alloy layers).

FIG. 28A shows the inner diameters and heights of blocking rings used for six lenses having a diameter of 80 mm and BCs of 1.5, 1.0, 0.9, 0.8, 0.7, and 0.6, the heights of lens holder units, and the gaps between the lens centers and the lens holder units (=central thicknesses of the alloy layers).

All the blocking rings 14 have an inner diameter of 78 mm and a height of 10 mm independently of the BC of the lens. Hence, one blocking ring suffices for the lenses having a diameter of 80 mm. On the other hand, two lens holder units 13 whose heights are 22.5 mm and 23.5 mm, respectively, are used. The gaps between the lenses 5 and the centers of the lens holder units 13 are 2.88 mm at maximum and 2.34 mm at minimum.

FIG. 28B shows the inner diameters and heights of blocking rings used for five lenses having a diameter of 75 mm and BCs of 2.0, 1.75, 0.5, 0.4, and 0.3, the heights of lens holder units, and the gaps between the lens centers and the lens holder units. All the blocking rings 14 have an inner diameter of 73 mm and a height of 7 mm independently of the BC of the lens. Hence, one blocking ring suffices for the lenses having a diameter of 75 mm. On the other hand, two lens holder units 13 whose heights are 19.5 mm and 20.5 mm, respectively, are used. The gaps between the lenses 5 and the centers of the lens holder units 13 are 2.80 mm at maximum and 1.90 mm at minimum.

FIG. 28C shows the inner diameters and heights of blocking rings used for six lenses having a diameter of 70 mm and BCs of 4.5, 3.75, 3.0, 2.5, 0.2, and 0.1, the heights of lens holder units, and the gaps between the lens centers and the lens holder units.

Two blocking rings 14 which have an inner diameter of 68 mm independently of the BC of the lens and heights of 10 mm and 7 mm, respectively, are used. Three lens holder units 13 whose heights are 18.5 mm, 19.5 mm, and 20.5 mm, respectively, are used. The gaps between the lenses 5 and the centers of the lens holder units 13 are 2.89 mm at maximum and 2.01 mm at minimum.

FIG. 28D shows the inner diameters and heights of blocking rings used for five lenses having a diameter of 65 mm and BCs of 7.5, 6.75, 6.0, 5.25, and 0.0, the heights of lens holder units, and the gaps between the lens centers and the lens holder units.

Two blocking rings 14 which have an inner diameter of 63 mm independently of the BC of the lens and heights of 10 mm and 7 mm, respectively, are used. Four lens holder units 13 whose heights are 17.5 mm, 18.5 mm, 19.5 mm, and 21.5 mm, respectively, are used. The gaps between the lenses 5 and the centers of the lens holder units 13 are 2.66 mm at maximum and 1.95 mm at minimum.

In the fifth embodiment, seven lens holder units 13 and six blocking rings 14 (two heights) are used. However, the numbers of lens holder units 13 and blocking rings 14 can be appropriately increased/decreased.

The number of kinds of blocking rings 14 used for lenses with different diameters is preferably one to two. If the number of blocking rings is three or more, it is cumbersome to store and manage them.

It is more preferable that the number of different heights of the lens holder units 13 be made larger than the number of kinds of heights of the blocking rings 14 to set the central thicknesses of the low-melting metal within a predetermined range. Attachment/detachment of the blocking ring 14 is time-consuming. In addition, the manufacturing cost of the blocking ring 14 is high. For these reasons, it is more advantageous to improve the operability and manufacturing cost by increasing the number of kinds of lens holder units 13 which can easily be detached and can be manufactured at a low cost.

The heights of the plurality of kinds of the lens holder units 13 are preferably set in the following way. First, the central thickness of the alloy layer to be set is set within the range of 1.90 to 3.00 mm. The heights of lens holder units are set at an interval equal to or smaller than the difference (to be referred to as a range width hereinafter) between the upper limit value and the lower limit value of the set range. It is more preferable to set the heights at a predetermined interval because management becomes easy. For example, when the central thickness of the alloy layer is set within the range of 1.90 to 3.00 mm, as in this embodiment, the range width of the set range is 1.10 mm. Lens holder units having different heights at an interval of 1.10 mm or less are prepared. In this embodiment, seven lens holder units were manufactured at a predetermined interval of 1.00 mm and combined with blocking rings which had different heights at an interval (3 mm) larger than the range width. Similarly, when the central thickness of the alloy layer is set within the range of 1.90 to 2.50 mm, the range width is 0.6 mm. Hence, lens holder units having different heights at an interval of 0.6 mm or less are prepared.

When the plurality of lens holder units whose heights are set at an interval equal to or smaller than the range width in the above-described manner are combined with blocking rings having appropriately heights and diameters, the central thickness of the alloy layer can be set within the set range independently of the diameter and BC of the lens. The number of kinds of lens holder units whose heights are set in this way is preferably larger than the number of kinds of heights of blocking rings because the central thickness can be set within the set range using a smaller number of blocking rings. Since lens holder units only need to be prepared in accordance with the diameters and BCs of lenses to which the lens holding tool should be attached, the interval between all the lens holder unit heights need not always be equal to or smaller than the set range width.

As described above, in the fifth embodiment of the present invention, to cut and polish the concave surfaces of the four lenses 5 having different diameters, the seven lens holder units 13 and six blocking rings 14 (two heights) are prepared. The lens holder unit 13 and blocking ring 14 are selectively used in correspondence with the diameter and BC of the lens 5 whereby the interval between the center of the convex surface 5*a* of the lens 5 and the upper surface of the lens holder unit 13, i.e., the central thickness M of the alloy layer 16 is set to an almost predetermined value and, more specifically, within the range of 1.90 to 3.00 mm. If the gap is smaller than 1.9 mm, the molten alloy layer 16 may be unable to flow into the gap between the lens 5 and the lens holder unit 13. It is undesirable because the alloy layer 16 is nonuniformly fixed to the lens surface to cause a dioptric power error. If the gap is larger than 3.00 mm, the use amount of the alloy 16 increases. This increases the influence of heat or shrinkage of the alloy layer 16, resulting in unstable dioptric power of the lens 5 and a large shape error of the concave surface 5*b*. It is more preferable that the gap be set within the range of 1.9 to 2.5 mm. Note that the thickness of the alloy layer 16 outside the lens holder unit 13 is 5 mm or more.

The lens 5 to which the lens holding tool 7 is attached in the above-described way is attached, via the lens holding tool 7, to the curve generator that executes three-dimensional NC control. Then, the concave surface 5*b* is cut into a predetermined surface shape (accuracy of finishing: within 3 μm, diameter: 50 [mm], surface roughness Ry: 0.3 to 0.5 μm).

The cut surface of the cut lens 5 is polished by the polishing apparatus.

In the lens holding tool 7 shown in the fifth embodiment of the present invention, seven lens holder units 13 having different heights and six blocking rings 14 having different heights and inner diameters are prepared. The lens holder unit 13 and blocking ring 14 each having a height corresponding to each of lenses having different diameters and BCs are selectively used to set the central thickness of the alloy layer 16 within the range of 1.90 to 3.00 mm and, more preferably, 1.9 to 2.5 mm. Accordingly, even for a lens having a high refractive index or a shallow concave surface, the influence of heat or shrinkage of the alloy layer 16 can be reduced, and the accuracy of the lens dioptric power can be maintained stable.

In the fifth embodiment of the present invention, the inner diameter of the blocking ring 14 is set to be almost equal to the diameter of the lens 5 such that the alloy layer 16 is fixed to almost the entire convex surface 5*a* of the lens 5. Accordingly, the boundary between the bonded portion and the unbonded portion of the alloy layer 16 can be moved close to the outer periphery of the lens 5. Hence, for a lens having a high refractive index, since no polishing marks are formed on the concave surface at the boundary between the bonded portion and the unbonded portion of the alloy layer 16, no shape error of the lens remains, and a lens with good optical performance can be manufactured.

In the fifth embodiment, since the gap between the lens center and the lens holder unit is set within the range of 1.90 to 3.00 mm and, more preferably, 1.9 to 2.5 mm, the use amount of the alloy 16 does not largely vary in accordance with the type of lens 5. Hence, the influence of heat can be further reduced.

Semifinished lenses (lenses in which only the first refractive surface is optically finished) are generally classified in accordance with the their sizes. For example, there are four diameters of 80, 75, 70, and 65 mm. Even lenses with the same diameter are classified into several types in accordance with the refracting power (dioptric power) of the first refractive surface.

The refracting power (dioptric power D: diopter) of a spectacle lens is approximately represented by the sum of a refracting power D1 of the first refracting surface (convex surface) and a refracting power D2 of the second refracting surface (concave surface) (D=D1+D2). The refracting power (surface refracting power) of each of the first and second refracting surfaces is defined by Surface refracting power=$(n-1)\times\rho=(n-1)/R$ where $\rho$ is the curvature of the surface (unit is 1/m, radius of curvature $R=1/\rho$), and n is the refractive index of the lens material.

The refracting power D1 of the first refracting surface is especially called a base curve (BC).

DETAILED EXAMPLES

In a semifinished lens of an epithio-based resin (refractive index: 1.71), when the central thickness of the lens is about 4.5 mm or less, the influence of heat or shrinkage of the alloy layer 16 especially increases. For a semifinished lens having a central thickness of 4.5 mm, the change amount of the surface refracting power of the lens 5 was measured while changing the central thickness of the alloy layer 16.

Experimental Conditions

Semifinished lens: epithio-based resin
(refractive index: 1.71)
central thickness=4.5 mm
BC=0.80
diameter=80 mm As the alloy 16, an alloy of Bi, Pb, Sn, Cd, and In (melting point: 47° C.) available from KK Osaka Asahi Metal Kojo was used.

Measuring Method

The lens holder unit was attached to the convex surface side of the semifinished lens via the alloy layer. After the alloy layer was cooled and hardened, the surface refractive index of the lens concave surface was measured, and a change rate from the surface refracting power of the lens concave surface before attachment of the lens holder unit, which was measured in advance, was obtained.

Figure 29:
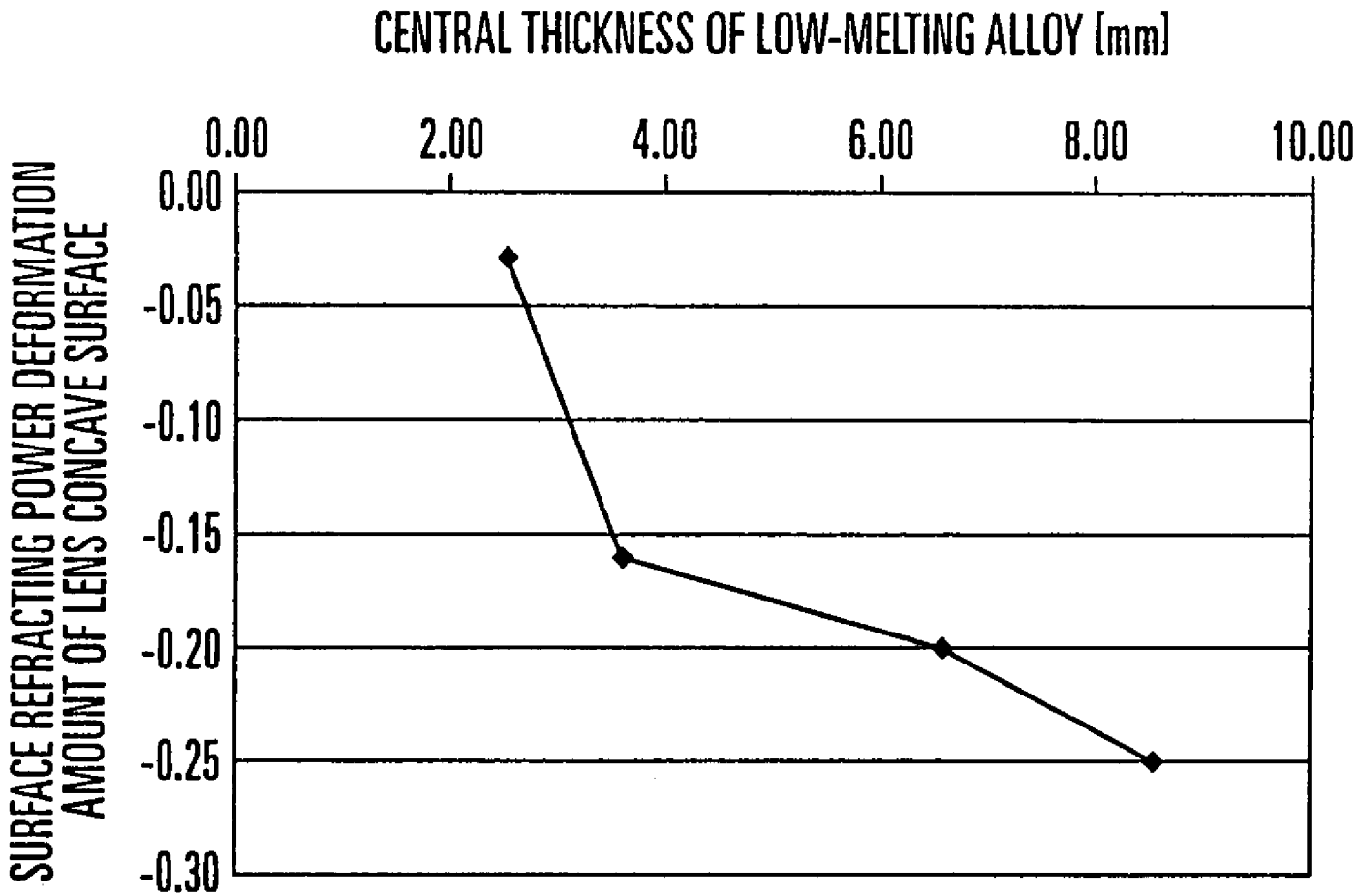
FIG. 29 is a graph showing the relationship between the amount of change in surface refracting power of a lens concave surface and the central thickness of a low-melting alloy.

FIG. 29 shows the relationship between the amount of change in surface refracting power of the lens concave surface and the central thickness of the low-melting alloy. As is apparent from FIG. 29, when the central thickness of the alloy layer is 3 mm or less, the refracting power change amount abruptly decreases.

In the above-described fifth embodiment, the present invention is applied to the lens holding tool 7 used for four lenses 5 whose diameters are 80, 75, 70, and 65 mm. However, the present invention is not limited to this and can also be applied to any other lens diameter.

The lens surface shape is not particularly limited. The lens may have a spherical surface, a toric surface, an aspherical surface, an atoric surface, or a free-form surface of, e.g., a progressive-power lens. The polishing jig has the balloon member 25 but may have, e.g., a metal pan.

As described above, for the lens holding tool 7 of the fifth embodiment shown in FIGS. 24 to 29, the height of the lens holder unit and the inner diameter and height of the blocking ring are set for each of lenses having different diameters and BCs. The gap between the lens center and the lens holder unit is set within the range of 1.90 to 3.00 mm and, more preferably, 1.9 to 2.5 mm. Hence, the influence of heat shrinkage of the low-melting alloy can be reduced. The accuracy and stability of the lens dioptric power can be increased. The present invention is especially suitable for polishing a lens which has a high refractive index and requires a small thickness.

In the fifth embodiment shown in FIGS. 24 to 29, the inner diameter of the blocking ring is almost equal to the diameter of the lens, and the almost entire convex surface of the lens is held by the low-melting alloy. For these reasons, even when polishing marks due to heat shrinkage are formed at the boundary between the low-melting alloy portion and the non-low-melting alloy portion in polishing the concave surface, the polishing marks can be removed by cutting and removing the outer peripheral portion of the lens by edging. Hence, a lens with good optical performance can be manufactured.

The lens holder unit according to the fifth embodiment shown in FIGS. 24 to 29 has, in the surface opposing the lens convex surface, holes that are tilted such that the opening portions are located close to the outer periphery of the lens holder unit while the internal end portions are located close to the center of the lens holder unit. Hence, the low-melting alloy is not thick at the central portion, and therefore, the influence of heat or shrinkage can be reduced. In addition, since the bonding strength between the lens holder unit and the low-melting alloy is high, undesirable removal or rotation of the low-melting alloy from the lens holder unit can be prevented.

Sixth Embodiment

Figure 31A:
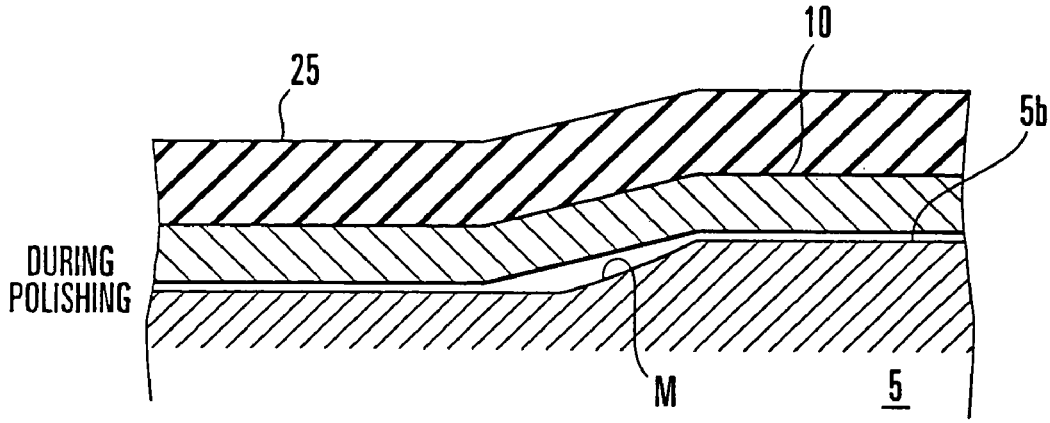
FIG. 31A is a view showing a polished surface during polishing according to the present invention.

As described above, when the concave surface of a lens is cut using an NC-controlled curve generator, a process step as shown in FIG. 31A is formed on the lens cut surface due to backlash.

To eliminate this process step, the following embodiment can be applied. In the following embodiment, a concave surface 5*b* formed from a toric surface of a spectacle lens 5 for correcting astigmatism is polished. As a curve generator, HSC100-A available from Schneider can be used.

Figure 30:
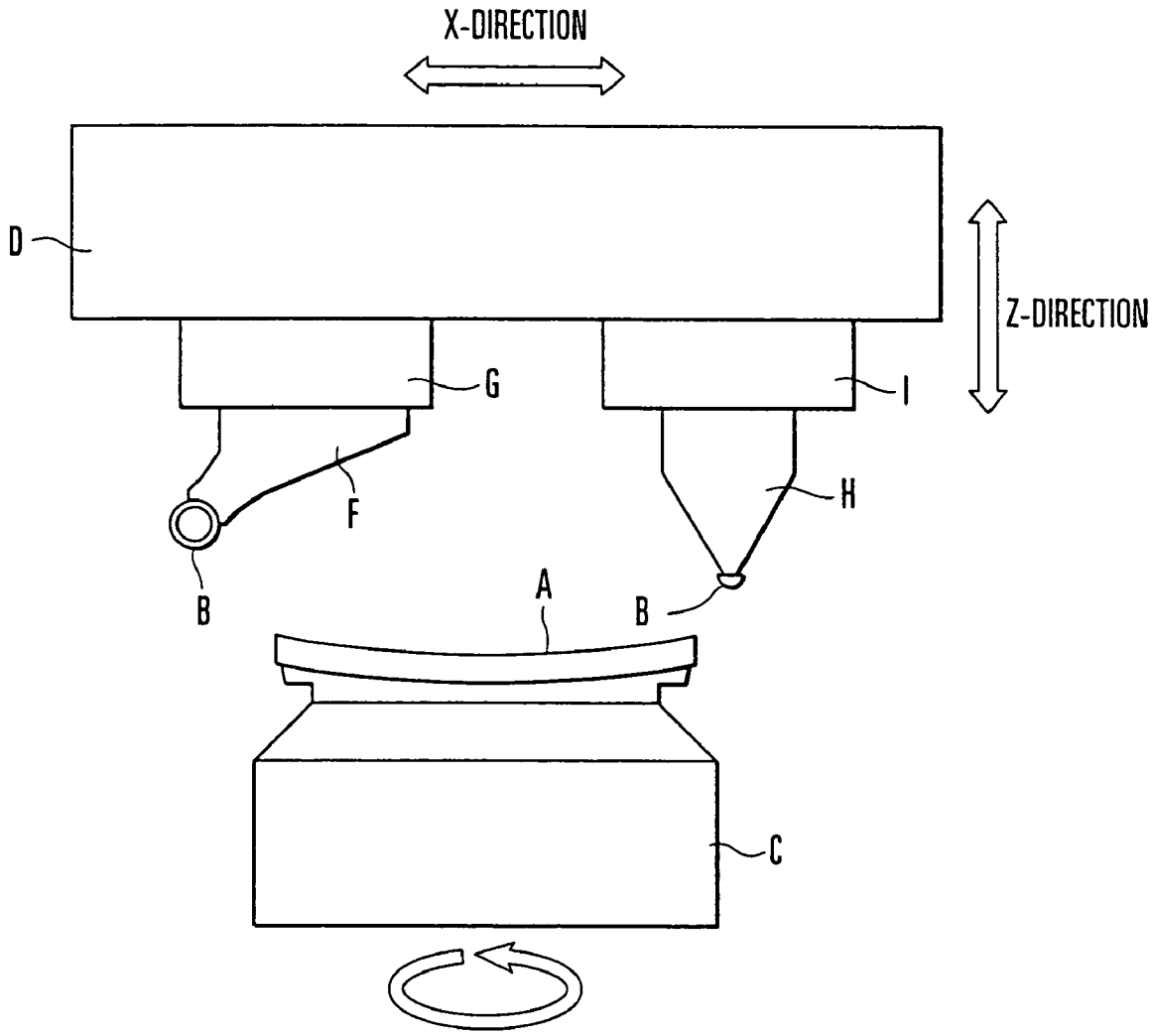
FIG. 30 is a schematic view of a curve generator used in the present invention.

FIG. 30 shows the curve generator HSC100-A available from Schneider. To cut a lens material A, polycrystalline diamond sintered as a turning tool or single-crystal natural diamond is used as a cutting edge B. In cutting, the lens A is attached to a lower shaft C side. The lower shaft C axially rotates without moving. The turning tool of an upper shaft D executes 2-axis control in the vertical direction and in the radial direction from the outer periphery of the lens. The lens is processed by control for a total of three axes. The lower shaft C of the curve generator is constructed by one shaft. The upper shaft D has two shafts, i.e., a first upper shaft portion G to which a first turning tool F for coarse cutting is attached and a second upper shaft portion I to which a second turning tool H for finishing is attached. The upper shaft D slides relative to the fixed lower shaft C to switch between the first and second upper shaft portions G and I. The accuracy of finishing of this curve generator is 3 μm or less (lens diameter: 50 mm), and a maximum surface roughness Ry is about 0.3 to 0.5 μm.

In the sixth embodiment, a polishing pad 10 is preferably hard. Hard felt or urethane foam is preferably used. When a hard polishing pad is used, the shape follow-up of the polishing pad to the process step when the polishing pad is pressed against the lens cut surface in polishing is suppressed to some extent. Hence, the process step can be removed.

The shape follow-up property of the polishing pad to the process step when the polishing pad is pressed against the lens cut surface is preferably set to be lower than that of the dome surface to the process step when the dome surface is pressed against the lens cut surface. With this setting, the dome surface is softer than the polishing pad. Since the dome surface can deform to make the polishing pad follow the shape of the cut surface when the polishing pad 10 is pressed against the lens cut surface in polishing, the surface can be satisfactorily polished while maintaining the surface shape of the cut surface accurately cut by the curve generator. In addition, since the dome surface is softer than the polishing pad, the dome surface comes into tight contact with the lower surface of the polishing pad when it is pressed against the lens cut surface. Since a uniform force can be applied to the lens polishing surface, the surface can be satisfactorily polished.

More specifically, in polishing, since the concave surface 5*b* of the lens 5 cut by the NC-controlled generator contains, in cut marks near the inflection point, a process step M having a height of 1 to 2 μm due to backlash or the like, as shown in FIG. 31A. The process step M must be removed by polishing. When the process step M should be removed by polishing, a suitable polishing force can be obtained by using a hard pad and an abrasive with a relatively large particle size. However, only with this, the surface roughness of polishing is limited because of the influence of particle size in polishing. In this embodiment, polishing is performed twice under different polishing conditions and, more particularly, using different abrasive particle sizes and polishing times. The process step M is removed by making a fine mirror surface.

More specifically, a first polishing process in which the cut surface accurately cut using the curve generator is coarsely polished while maintaining the its surface shape, and a second polishing process in which the surface polished by the first polishing step is finished are executed.

Figure 31B:
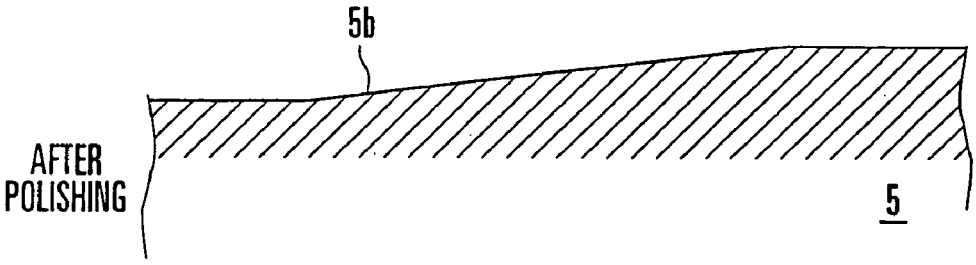
FIG. 31B is a view showing the polished surface after polishing.

In the first polishing process, an abrasive prepared by dispersing abrasive particles (aluminum oxide) with an average particle size of 1.4 to 3.0 μm into an abrasive solution (e.g., aqueous nitric acid solution) is used. In this embodiment, an abrasive (to be referred to as an abrasive A hereinafter) made of aluminum oxide having an average particle size of 1.5 μm was used. Coarse polishing is performed while controlling the temperature to 8° C to 14° C. The polishing time is 2 to 6 min, the polishing pressure is 10 to 400 mb, and the rotational speed is 400 to 600 rpm. With this first polishing process, the process step M that is present before polishing is almost completely removed, as shown in FIG. 31B.

Subsequently, the second polishing process is performed. In the second polishing process, the polishing pad 10 used in the first polishing process is replaced with a new pad. Finishing is performed using an abrasive prepared by dispersing abrasive particles (aluminum oxide) with an average particle size of 0.5 to 1.2 μm into an abrasive solution (e.g., aqueous nitric acid solution). In this embodiment, an abrasive (to be referred to as an abrasive B hereinafter) made of aluminum oxide having an average particle size of 0.8 μm was used. The polishing time is 30 sec to 1 min, the polishing pressure is 5 to 400 mb, and the rotational speed is 400 to 1,000 rpm.

Figures 32, 33:
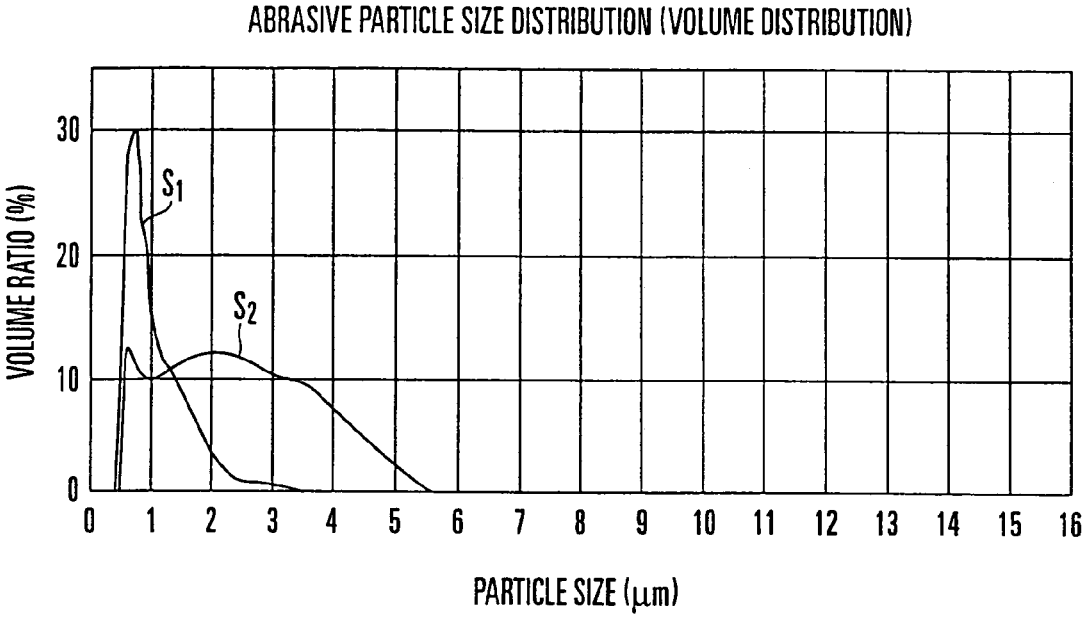
FIG. 32 is a graph showing the particle sizes and particle size distributions of abrasives.
FIG. 33 is a table showing the specific gravities, average particle sizes, and PH values of abrasives.
Figure 34:
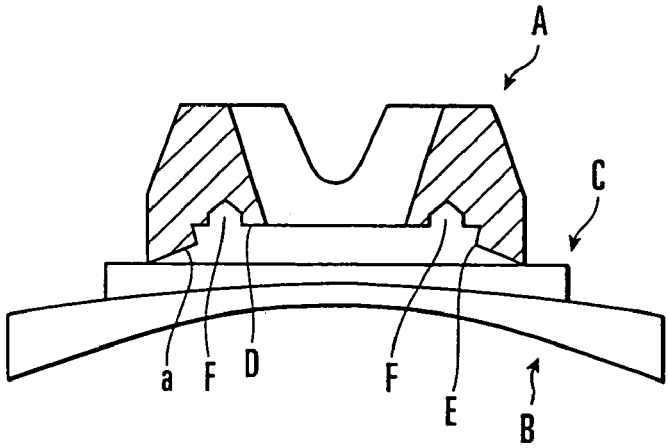
FIG. 34 is a sectional view showing the structure of a conventional lens holder unit.
Figure 35A:
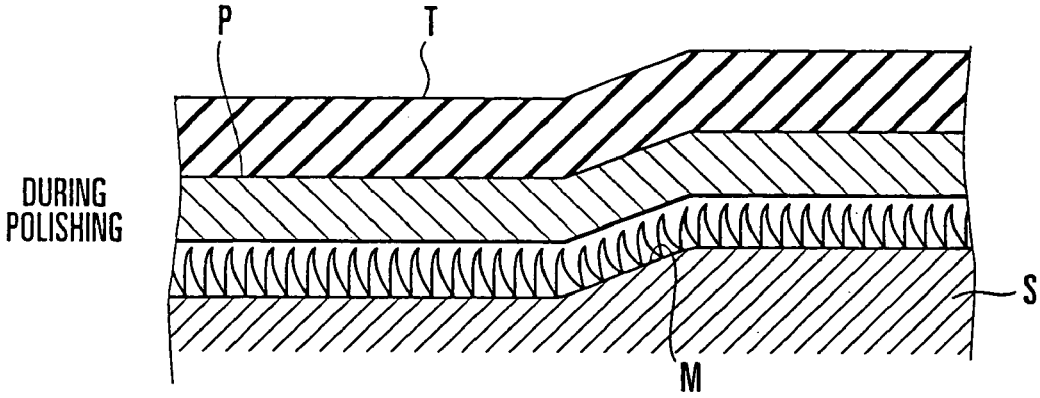
FIG. 35A is a view showing a polished surface during polishing by a conventional polishing method.
Figure 35B:
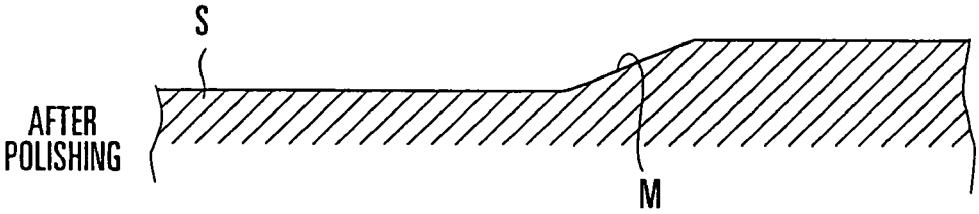
FIG. 35B is a view showing the polished surface after polishing.

FIG. 32 shows the particle sizes and particle size distributions of the abrasives A and B. Referring to FIG. 32, a curve S1 indicates the particle size distribution of the abrasive B, and a curve S2 indicates the particle size distribution of the abrasive A.

As is apparent from these characteristics, the abrasive B has a small variation in particle size distribution and is therefore suitable for finishing. In this graph, the ordinate represents the volume ratio, and the abscissa represents the particle size of the abrasive.

FIG. 33 shows the specific gravities, average particle sizes, and PH values of the abrasives A and B.

When polishing by a polishing apparatus 1 is ended, the lens 5 is detached from the polishing apparatus 1. Visual inspection, dioptric power inspection using a lens meter, lens inner surface projection inspection using transmission light of a zircon lamp, and astigmatism optical performance inspection are performed. As is also apparent from the inspection results, the lens 5 polished by the polishing method according to the above-described embodiment of the present invention had a high outer appearance quality, optical accuracy, and dimensional accuracy.

In the sixth embodiment, the hard polishing pad 10 is used. Since the polishing margin need not be increased more than necessary, as compared to the conventional polishing method using a soft polishing pad, the polishing time can be shortened.

In the above-described sixth embodiment, the concave surface 5*b* formed from a toric surface of the spectacle lens 5 for correcting astigmatism is polished. However, the present invention is not particularly limited to this and can also be used to polish a concave surface formed from a spherical surface, aspherical surface, atoric surface, or free-form surface.

As described above, when the optical lens polishing method shown in FIGS. 30 to 33 is used, in the method of polishing the cut surface of an optical lens cut by an NC-controlled cutting machine, the process step formed near the inflection point of the cut surface can reliably be removed by the first polishing process. The polished surface polished by the first polishing process can be finished by the second polishing process. As a result, an optical lens having a high outer appearance quality, optical accuracy, and dimensional accuracy can be manufactured in a short time. The method is particularly suitable for manufacturing a plastic spectacle lens having a complex concave surface shape such as an aspherical surface, atoric surface, or free-form surface.

In the sixth embodiment shown FIGS. 30 to 33, in the first polishing process, the average particle size of the abrasive is 1.4 to 3.0 μm, and the polishing time is 2 to 6 min. In the second polishing process, the average particle size of the abrasive is 0.5 to 1.2 μm, and the polishing time is 30 sec to 1 min. Hence, the process step on the cut surface can be satisfactorily removed. In addition, a polished surface having a higher optical accuracy and dimensional accuracy can be obtained.

In the sixth embodiment shown in FIGS. 30 to 33, the polishing pad is replaced with a new pad every time for each polishing cycle. Hence, in the second polishing process, the surface can be satisfactorily finished without being polished by the abrasive particles used in the first polishing process.

In the sixth embodiment shown in FIGS. 30 to 33, the hardnesses of the polishing pad and dome surface are set such that the shape follow-up property of the polishing pad to the process step when the polishing pad is pressed against the lens surface becomes lower than that of the dome surface to the process step when the dome surface is pressed against the lens cut surface. Hence, the surface can be satisfactorily polished while maintaining the accurately cut surface shape. In addition, the process step can reliably be removed.

The fluid used in the above-described embodiments is compressed air. However, any other fluid capable of expanding/contracting the balloon member may be used.

In the above-described embodiments, a concave surface has been mainly described as a surface to be polished. However, the present invention can also be applied to polish a convex surface or a flat surface. For example, the balloon member of the present invention is used to polish a convex surface of a lens. When the convex surface of the lens is pressed against the balloon member, the balloon member can deform and follow up to the convex surface shape of the lens. This also applies to polishing of a flat surface.

What is claimed is:

1. A method of forming a lens holding tool formed from a lens holder unit and an alloy layer by fixing the lens holder unit and a blocking ring to a mount, laying out a lens which has a convex surface directed to a side of the lens holder unit and is separated from the lens holder unit, and supplying a molten low-melting alloy to a space formed by the lens holder unit, the blocking ring, and the lens and hardening the low-melting alloy to form the alloy layer, wherein the lens holder unit is selected from a plurality of kinds of lens holder units having different heights, the blocking ring is selected from a plurality of kinds of blocking rings having different inner diameters and different heights, and the lens holder unit and blocking ring are combined so as to set a central thickness of the alloy within a predetermined range independently of a type of lens.

2. A method according to claim 1, wherein a central thickness of the alloy layer is 1.90 to 3.00 mm.

3. A method according to claim 1, wherein a thickness of the alloy layer located outside the lens holder unit is not less than 5 mm.

4. A method according to claim 1, wherein the number of heights of the lens holder units is larger than the number of heights of the blocking rings, and the plurality of kinds of lens holder units have different heights at an interval not more than 1.1 mm.

* * * * *